US011273632B2

(12) United States Patent
Sueyasu et al.

(10) Patent No.: US 11,273,632 B2
(45) Date of Patent: Mar. 15, 2022

(54) SCREEN PRINTING APPARATUS, MASK CLEANER, AND BLADE

(71) Applicant: Panasonic Intellectual Property Management Co., Ltd., Osaka (JP)

(72) Inventors: Yusuke Sueyasu, Fukuoka (JP); Masayuki Mantani, Saga (JP); Yoshinori Isobata, Fukuoka (JP); Susumu Toyoda, Fukuoka (JP); Ryo Senoo, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 311 days.

(21) Appl. No.: 16/292,763

(22) Filed: Mar. 5, 2019

(65) Prior Publication Data

US 2019/0275787 A1 Sep. 12, 2019

(30) Foreign Application Priority Data

Mar. 12, 2018 (JP) ..... JP2018-043718
Mar. 12, 2018 (JP) ..... JP2018-043719

(51) Int. Cl.
*B41F 15/12* (2006.01)
*B41F 35/00* (2006.01)
(Continued)

(52) U.S. Cl.
CPC ..... *B41F 35/008* (2013.01); *B41F 15/08* (2013.01); *B41F 15/12* (2013.01); *B41F 15/34* (2013.01);
(Continued)

(58) Field of Classification Search
CPC ..... B41F 35/005; B41F 35/003; B41F 15/12; B41F 15/08; B41F 15/40; B41F 15/34;
(Continued)

(56) References Cited

U.S. PATENT DOCUMENTS 4,078,486 A * 3/1978 Moser ..... B41F 9/1036 101/120
5,309,837 A * 5/1994 Nanzai ..... B41F 35/003 101/425
(Continued)

FOREIGN PATENT DOCUMENTS

CN 104470723 A * 3/2015 ..... B41F 15/423
JP 05318712 A * 12/1993
(Continued)

OTHER PUBLICATIONS

EPO English language translation of CN104470723A, which has a publication date of Mar. 25, 2015 (Year: 2015).*
English translation of JP 05-318712A, publication date Dec. 3, 1993. (Year: 1993).*

*Primary Examiner* — Leslie J Evanisko
(74) *Attorney, Agent, or Firm* — Pearne & Gordon LLP

(57) ABSTRACT

A screen printing apparatus includes a print head, a moving base, and a mask cleaner. The print head prints a paste onto a board through the mask. The moving base moves under the mask in a horizontal paste scraping direction. The mask cleaner is mounted to the moving base and moves under the mask integrally with the moving base, and scrapes off the paste adhering to a lower surface of the mask. A base body is mounted to the moving base and includes a longitudinal side being horizontal and intersecting the paste scraping direction. Plurality of blades are detachably mounted to the base body and extending in the longitudinal direction and are arranged side by side in parallel to the paste scraping direction and cause a paste scraping edge protruding upward from the base body to come into abutment against the lower surface of the mask.

19 Claims, 21 Drawing Sheets

(51) Int. Cl.
*B41F 15/34* (2006.01)
*B41F 15/40* (2006.01)
*B41F 15/08* (2006.01)

(52) U.S. Cl.
CPC ..... *B41F 15/40* (2013.01); *B41F 35/003* (2013.01); *B41F 35/005* (2013.01); *B41P 2235/21* (2013.01)

(58) Field of Classification Search
CPC ..... B08B 1/005; B08B 1/008; H05K 3/1216; H05K 3/1225; H05K 3/1233; B41P 2235/21
USPC ..... 101/423, 425, 114; 15/93.1, 93.4, 246, 15/256.5, 256.53
See application file for complete search history.

(56) References Cited

U.S. PATENT DOCUMENTS

2003/0037804 A1* 2/2003 Erdmann ..... B23K 1/018 134/9
2011/0061549 A1* 3/2011 Nishi ..... B41F 35/005 101/114

FOREIGN PATENT DOCUMENTS

| | | | | |
|---|---|---|---|---|
| JP | H07-052359 | A | | 2/1995 |
| JP | 2000-062131 | A | | 2/2000 |
| JP | 2016-196101 | A | | 11/2016 |
| KR | 20150144495 | A | * | 12/2015 |
| WO | 2014/013592 | A1 | | 1/2014 |

* cited by examiner

SCREEN PRINTING APPARATUS, MASK CLEANER, AND BLADE

BACKGROUND

1. Technical Field

The present disclosure relates to a screen printing apparatus for printing a paste on a board through a mask, a mask cleaner for cleaning the mask of the screen printing apparatus, and a blade for use in the mask cleaner.

2. Description of the Related Art

In a screen printing apparatus, a mask is brought into contact with a board and a paste is printed onto the board through pattern holes formed in the mask. In such a screen printing apparatus, it is necessary to scrape off the paste from a lower surface of the mask to clean it periodically so as not to lower the print quality of the subsequent board. A mask cleaner used for cleaning a mask includes a base body mounted to a moving base moving under the mask in a horizontal paste scraping direction and moving under the mask integrally with the moving base, and a cleaning member mounted to the base body. In the mask cleaner, the base body moves with the cleaning member in abutment against the lower surface of the mask, thus scraping off the paste adhering to the lower surface of the mask. In related art, the cleaning member is a member made of paper (cleaning paper), but instead of the cleaning paper, use of a thin "spatula"-like paste scraping tool (blade) formed of a metal such as SUS is also known (for example, Japanese Patent Unexamined Publication No. 2016-196101).

In the mask cleaner using the blade in place of the cleaning paper as described above, the base body includes a frame having an opening opened upward and a blade holder having a plurality of beams mounted in the opening of the frame and arranged at intervals in a longitudinal direction of the base body. The blade holder holds a plurality of blades, and the plurality of beams support the blades at intermediate portions of the blades in the longitudinal direction. Each of the plurality of blades is inserted into each of a plurality of rows of grooves formed in the blade holder from above and positioned. The blades held by the blade holder are fixed to the base body as both end portions in the longitudinal direction are pressed by a blade pressing member. In this state, the edge protruding upward from the base body is brought into abutment against the lower surface of the mask and used as a paste scraping edge for scraping off the paste.

However, the screen printing apparatus disclosed in Japanese Patent Unexamined Publication No. 2016-196101 has a problem that, when the blade is disassembled from the base body for cleaning, if an operator excessively bends the blade by mistake, the blade is plastically deformed, and the paste scraping edge does not come into contact with the lower surface of the mask, resulting in cleaning quality deterioration.

In addition, improvement of the service life of the blade has also been desired.

Therefore, the present disclosure aims to solve the above problem.

SUMMARY

A screen printing apparatus according to the present disclosure includes a print head that prints a paste onto a board through a mask, a moving base moving under the mask in a horizontal paste scraping direction, and a mask cleaner mounted to the moving base, moving under the mask integrally with the moving base, and scraping off the paste adhering to a lower surface of the mask. The mask cleaner includes a base body mounted to the moving base and including a longitudinal side, the longitudinal side being horizontal and intersecting the paste scraping direction, and a plurality of blades detachably mounted to the base body, extending in the longitudinal direction and arranged side by side in parallel to the paste scraping direction, and causing a paste scraping edge protruding upward from the base body to come into abutment against the lower surface of the mask, in which each of plurality of blades is formed of resin.

A mask cleaner according to the present disclosure is provided in a screen printing apparatus for printing a paste onto a board through a mask, in which the mask cleaner is mounted to a moving base that moves in a horizontal paste scraping direction under the mask, and moves under the mask integrally with the moving base to scrape off the paste adhering to the lower surface of the mask. The mask cleaner includes a base body mounted to the moving base and including a longitudinal side, the longitudinal side being horizontal and intersecting the paste scraping direction, and a plurality of blades detachably mounted to the base body, and extending in the longitudinal direction and arranged side by side in parallel to the paste scraping direction, and cause a paste scraping edge protruding upward from the base body to come into abutment against the lower surface of the mask, in which the blade is formed of resin.

A blade according to the present disclosure is provided for use with a mask cleaner provided in a screen printing apparatus for printing a paste onto a board through a mask, in which the mask cleaner is mounted to a moving base that moves in a horizontal paste scraping direction under the mask, and moves under the mask integrally with the moving base to scrape off the paste adhering to the lower surface of the mask. The blade is formed of resin, is detachably mounted to a base body that is mounted to the moving base and including a longitudinal side, the longitudinal side being horizontal and intersecting the paste scraping direction, extends in the longitudinal direction, and cause a paste scraping edge protruding upward from the base body to come into abutment against the lower surface of the mask.

According to the present disclosure, it is possible to prevent deterioration of the cleaning quality due to bending of the blade.

DETAILED DESCRIPTION

Figure 1:
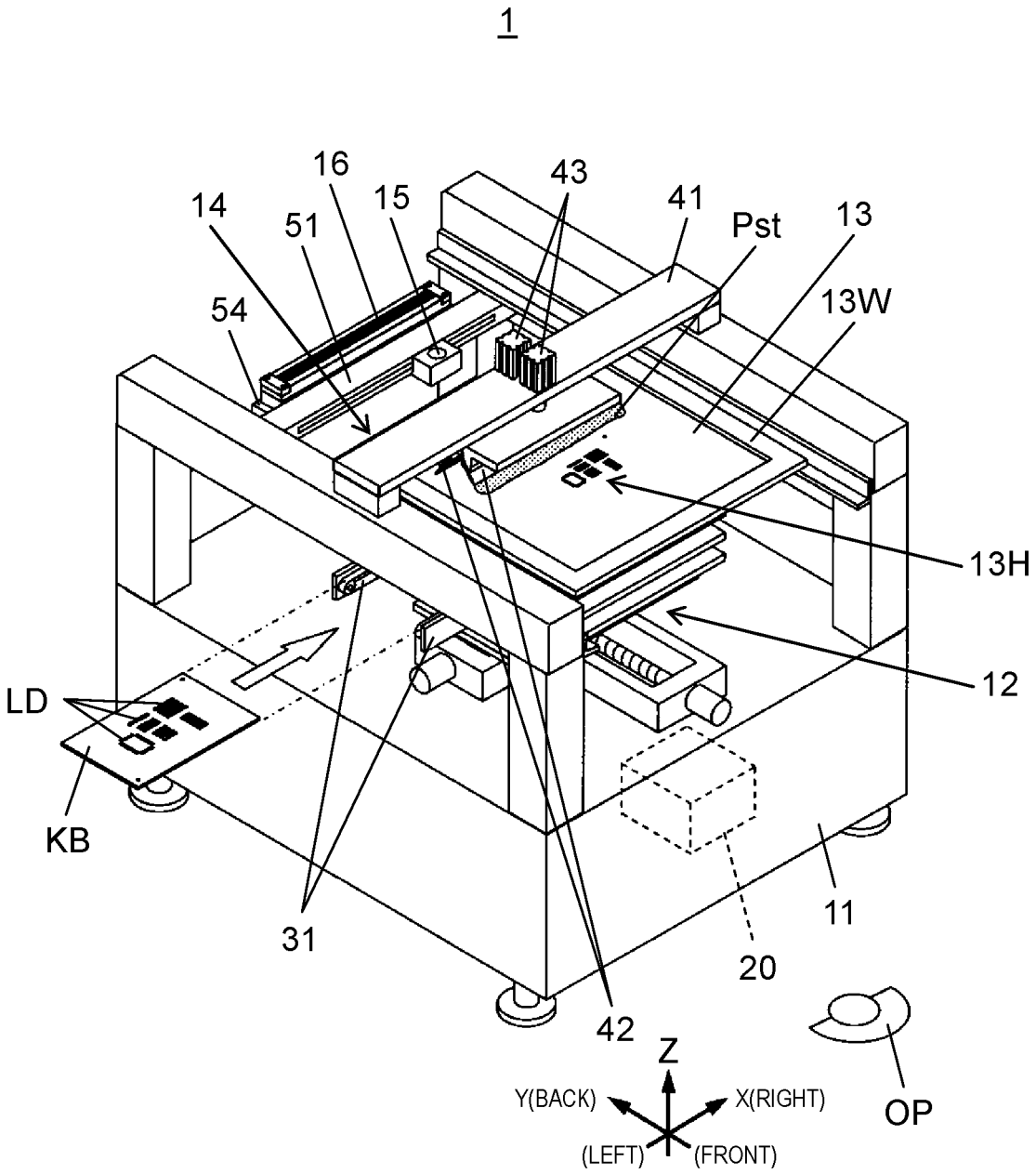
FIG. 1 is a perspective view of a screen printing apparatus according to an embodiment of the present disclosure.
Figure 2:
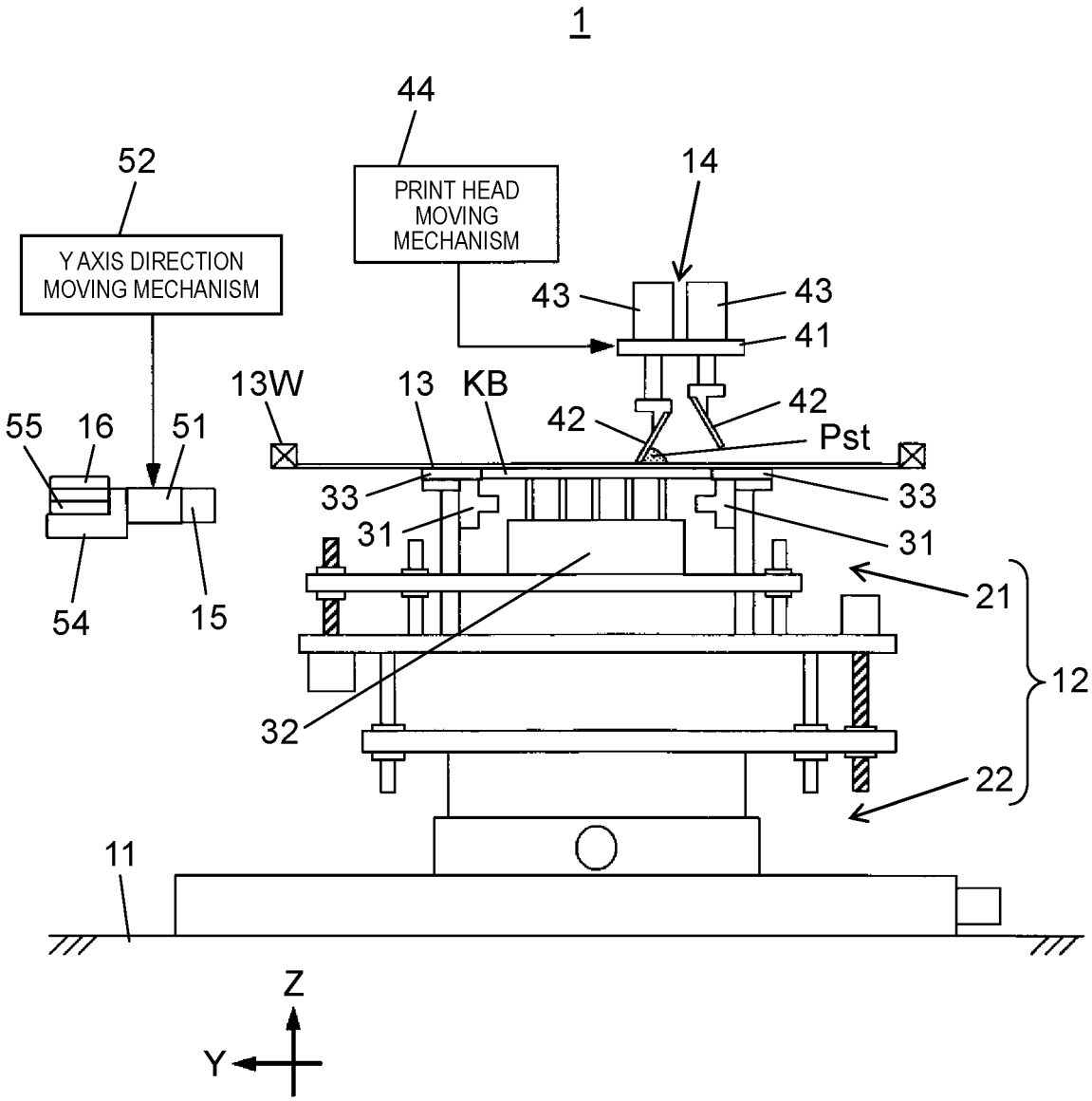
FIG. 2 is a side view of a screen printing apparatus according to an embodiment of the present disclosure.

Hereinafter, embodiments of the present disclosure will be described with reference to the drawings. FIGS. 1 and 2 illustrate screen printing apparatus 1 according to an embodiment of the present disclosure. Screen printing apparatus 1 is an apparatus that carries-in board KB supplied from an upstream process side, prints paste Pst such as solder onto each of plurality of lands LD provided on a surface of board KB and carries-out board KB to a downstream process side. For convenience of explanation, it is assumed that a front-back direction of screen printing apparatus 1 viewed from operator OP is a Y axis direction, a left-right direction thereof viewed from operator OP (a conveyance direction of board KB) is an X axis direction, and a perpendicular direction thereof is a Z-axial direction. Further, it is assumed that, in the Y axis direction, a front side thereof viewed from operator OP is a forward side, and a back side thereof viewed from operator OP is a rearward side.

In FIGS. 1 and 2, screen printing apparatus 1 includes board stage 12 on a base 11. Mask 13 is disposed above board stage 12, and print head 14 is installed above mask 13. Camera 15 and mask cleaner 16 are provided between board stage 12 and mask 13. Controller 20 having an arithmetic unit, a storage and the like for executing a program is housed inside base 11. Controller 20 controls screen printing apparatus 1 and causes screen printing apparatus 1 to perform a screen printing operation, a cleaning operation of mask 13, and the like.

In FIG. 2, board stage 12 includes board holder 21 and board holder moving mechanism 22. Board holder 21 includes a pair of transfer conveyors 31 arranged side by side in parallel to the Y axis direction to transfer the board, lower receiver 32 for supporting board KB transported by the pair of transfer conveyors 31 from below, and a pair of dampers 33 provided on upper portions of the pair of transfer conveyors 31 and openable and closable in the Y axis direction. Board holder 21 receives board KB received by the pair of transfer conveyor 31 by lower receiver 32 and clamps board KB by the pair of dampers 33 to hold board KB. Board holder moving mechanism 22 includes an orthogonal coordinate table mechanism or the like, and moves board holder 21 in an XY in-plane direction, the Z axis direction and a direction around Z axis, and thereby moves board KB held by board holder 21.

In FIGS. 1 and 2, mask 13 has a rectangular shape extending in the XY plane. Mask 13 is formed as a metal plate member with four sides supported by frame member 13W. Pattern holes 13H are provided in the central portion of mask 13, in a form corresponding to an arrangement of lands LD of board KB.

In FIGS. 1 and 2, print head 14 has a configuration in which two squeegees 42 are provided below head base 41, having a shape extending in the X axis direction. Two squeegees 42 are formed as "spatula" shaped members extending in the X axis direction and are disposed to face each other in the Y axis direction. Squeegee lifting driver 43 for individually lifting two squeegees 42 is provided on an upper surface of head base 41. Head base 41 moves freely in the Y axis direction and is driven by print head moving mechanism 44 (FIG. 2) to move above mask 13 in the Y axis direction.

In FIGS. 1 and 2, moving beam 51 extending in the X axis direction is disposed under mask 13, and camera 15 is mounted to a forward side of moving beam 51. Moving beam 51 moves freely in the Y axis direction, and is driven by Y axis direction moving mechanism 52 (FIG. 2) to move under mask 13 in the Y axis direction. In addition, camera 15 moves along moving beam 51 in the X axis direction by X axis direction moving mechanism 53 (FIG. 3) provided on moving beam 51.

Camera 15 has a function of imaging both the upper side and the lower side. Camera 15 moves in the horizontal plane (in the XY plane) under mask 13 by the movement of camera 15 itself in the X axis direction and the movement of moving beam 51 in the Y axis direction, to image board KB held by board holder 21 from above and also to image mask 13 from below.

In FIGS. 1 and 2, cleaner mounting portion 54 extending in the X axis direction is mounted to a rearward side of moving beam 51. Cleaner mounting portion 54 moves together with moving beam 51 in the Y axis direction. Moving base 55 is movably provided on the rearward side of cleaner mounting portion 54 to be lifted up and down, and mask cleaner 16 is mounted to moving base 55 (see also FIG. 3).

Figure 3:
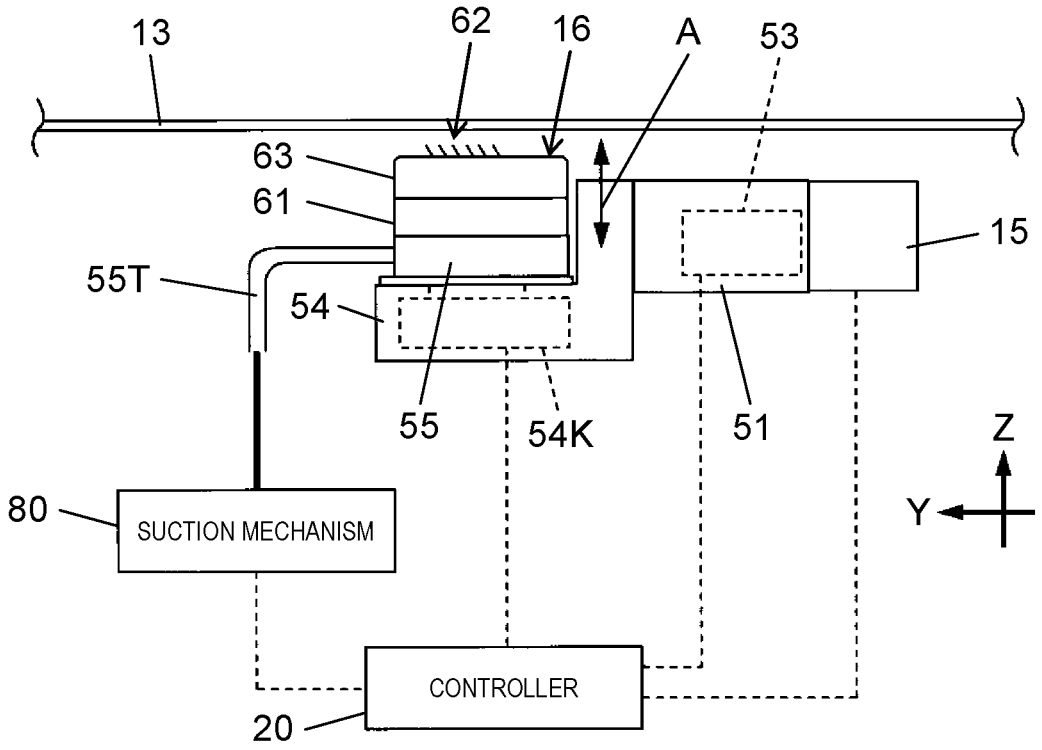
FIG. 3 is a side view showing a mask cleaner included in a screen printing apparatus together with a mask, according to an embodiment of the present disclosure.

In FIG. 3, cleaner mounting portion 54 is provided with lifting mechanism 54K, and moving base 55 is lifted and lowered by lifting mechanism 54K. Lifting mechanism 54K includes an actuator driven by pneumatic or hydraulic pressure. When lifting mechanism 54K lifts and lowers moving base 55, mask cleaner 16 is lifted up and lowered down with respect to moving beam 51 (arrow A in FIG. 3).

Figure 8A:
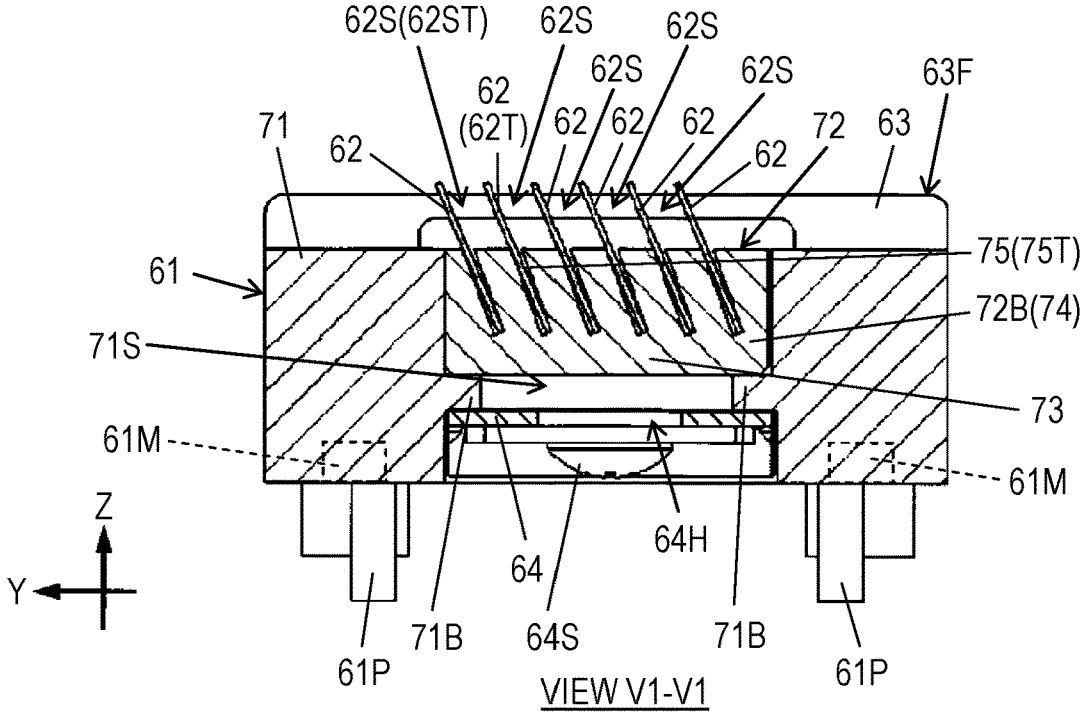
FIG. 8A is a cross-sectional view of a mask cleaner included in a screen printing apparatus according to an embodiment of the present disclosure.
Figure 8B:
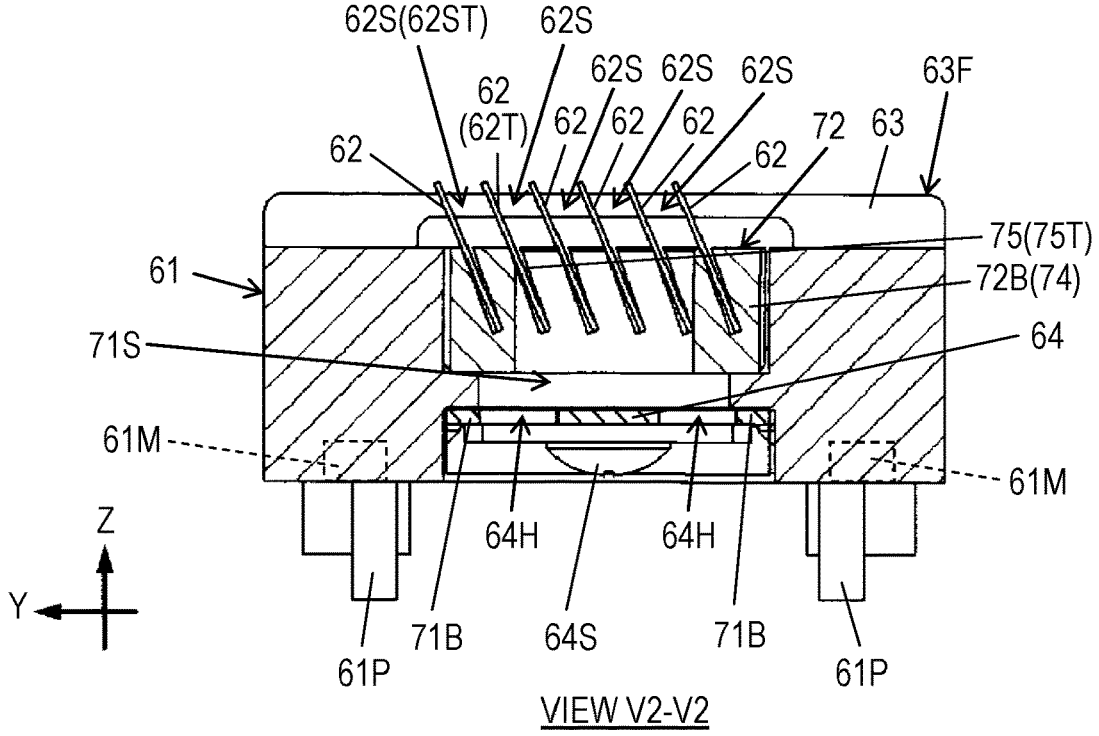
FIG. 8B is a cross-sectional view of a mask cleaner included in a screen printing apparatus according to an embodiment of the present disclosure.

In FIGS. 4, 5A, 5B and 5C, mask cleaner 16 has a shape generally extending in the X axis direction. As shown in FIGS. 6, 7, 8A and 8B, mask cleaner 16 is provided with base body 61, a plurality of (in this case, six pieces of) blades 62, a pair of end members 63, straightening vane 64, and the like. Here, FIG. 8A is a cross-sectional view taken along arrow V1-V1 in FIG. 7 (a cross sectional view traversing one entire beam 73), and FIG. 8B is a cross sectional view taken along arrow V2-V2 in FIG. 7 (a cross sectional view without traversing beam 73).

Figure 5A:
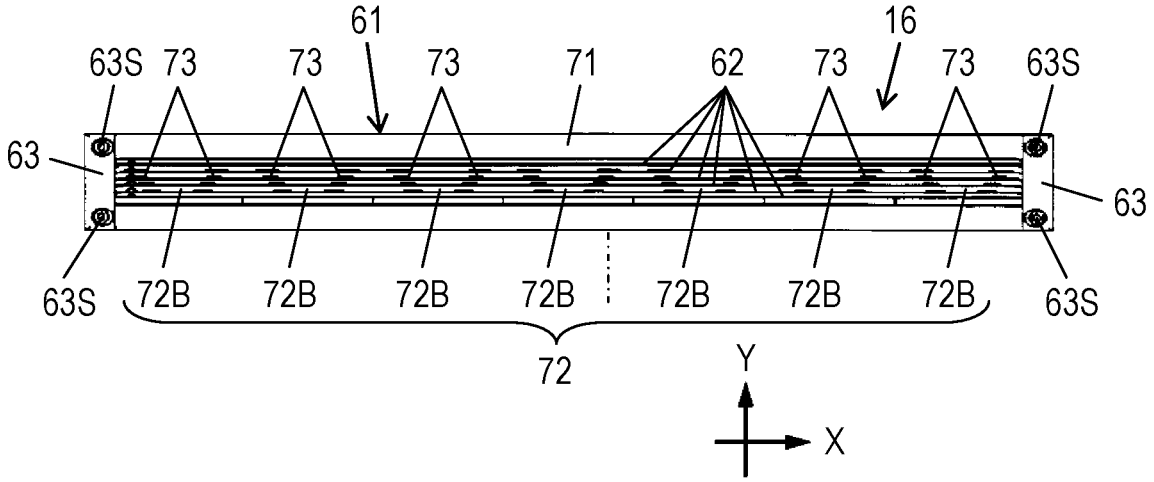
FIG. 5A is a plan view of a mask cleaner included in a screen printing apparatus according to an embodiment of the present disclosure.
Figure 6:
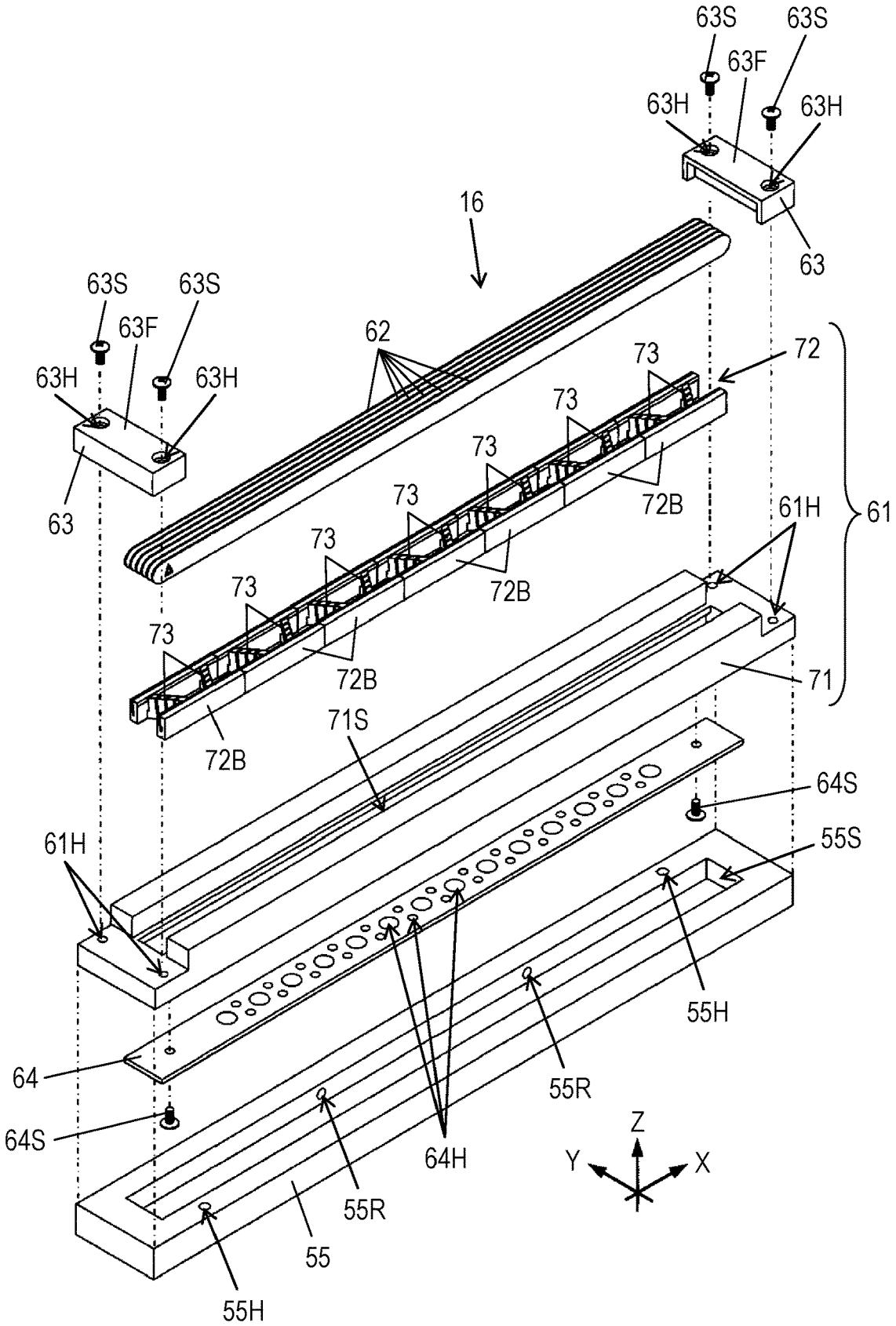
FIG. 6 is an exploded perspective view of a mask cleaner and a moving base included in a screen printing apparatus according to an embodiment of the present disclosure.
Figure 7:
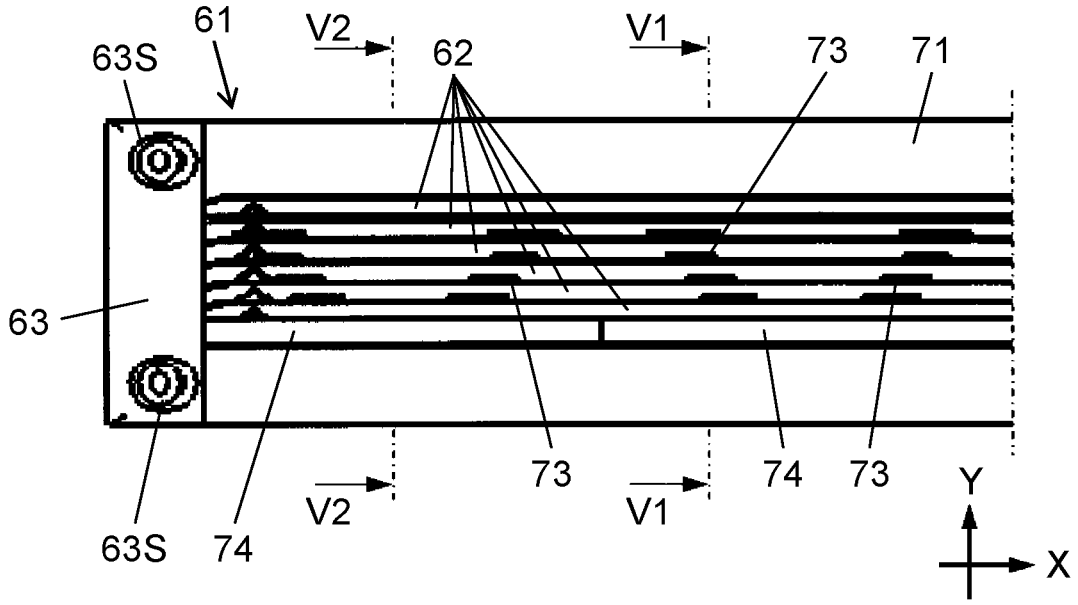
FIG. 7 is a plan view of a part of a mask cleaner included in a screen printing apparatus according to an embodiment of the present disclosure.
Figure 9:
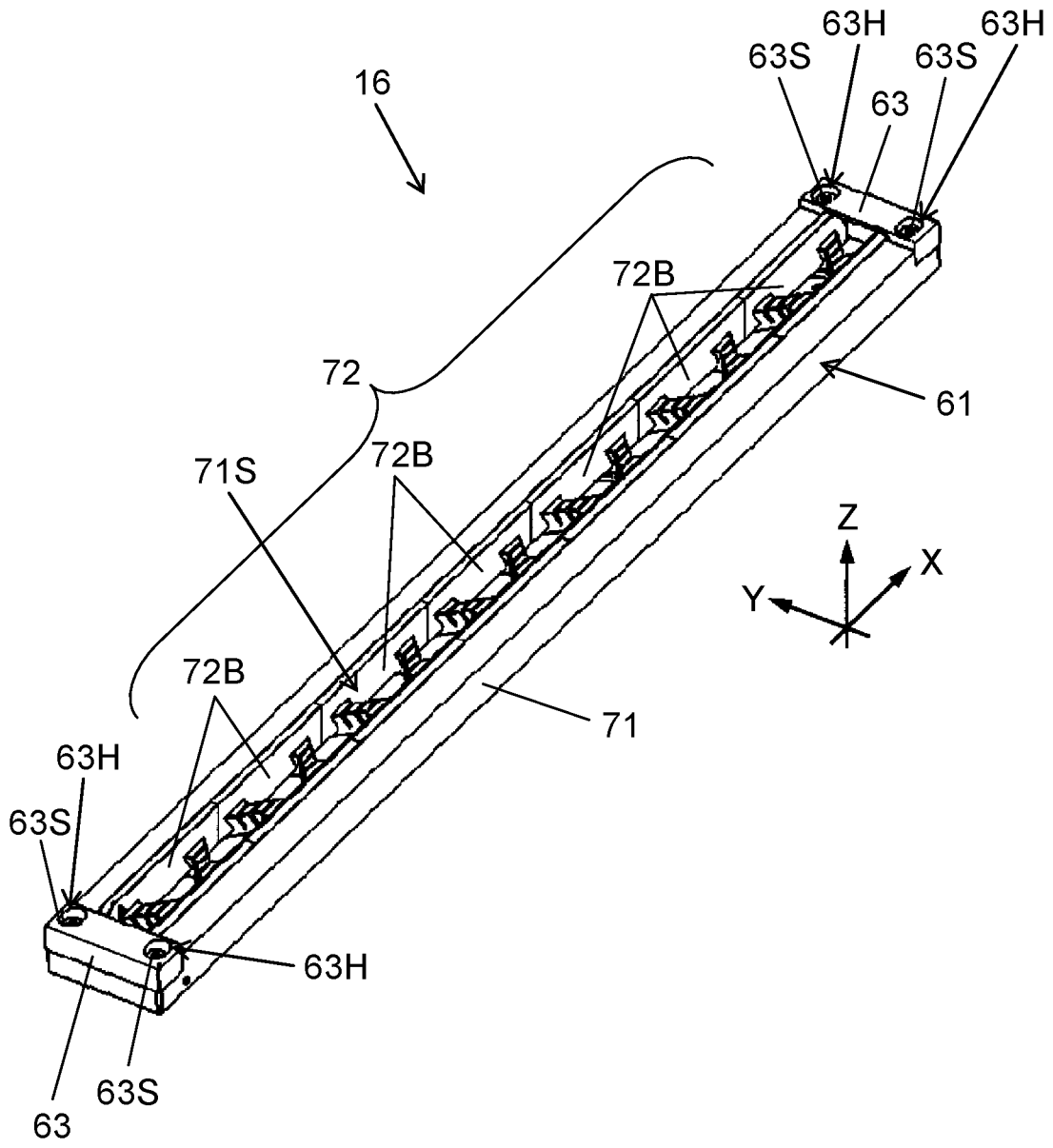
FIG. 9 is a perspective view of a base portion of a mask cleaner included in a screen printing apparatus according to one embodiment of the present disclosure.

In FIGS. 5A, 6, and 9, base body 61 extends in a horizontal direction intersecting with the Y axis direction (referred herein as "paste scraping direction"), which is the direction in which paste Pst is scraped off by mask cleaner 16, as a longitudinal direction (corresponding to the X axis direction), and includes frame 71 and blade holder 72. Frame 71 is a rectangular frame member extending in the longitudinal direction of base body 61, and includes opening 71S penetrating a central portion in a perpendicular direction and opened upward. Blade holder 72 is mounted to opening 71S of frame 71 and includes a plurality of beams 73 arranged at intervals in the longitudinal direction (X axis direction) of base body 61.

In the present embodiment, blade holder 72 includes a plurality (here, 7 pieces) of block members 72B removably mounted to frame 71 (FIGS. 5A, 6, and 9). Plurality of block members 72B have the same shape as each other.

Figure 10:
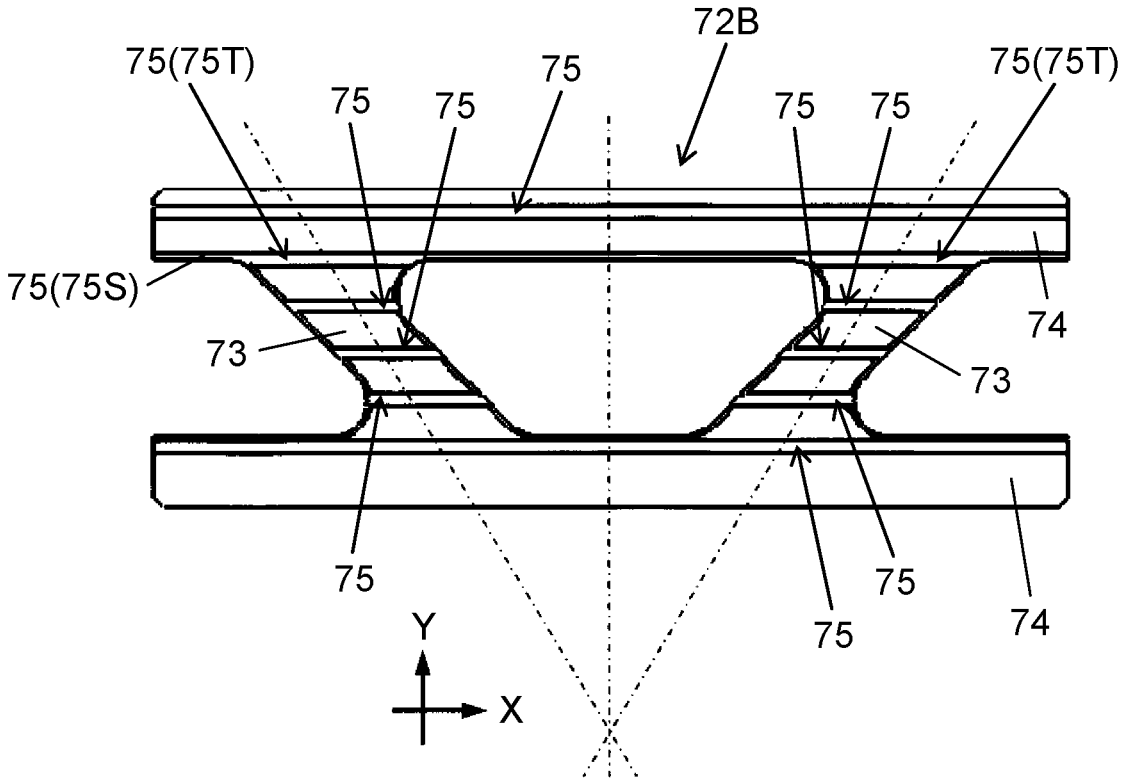
FIG. 10 is a plan view of a block member forming a base portion of a mask cleaner included in a screen printing apparatus according to an embodiment of the present disclosure.
Figure 11:
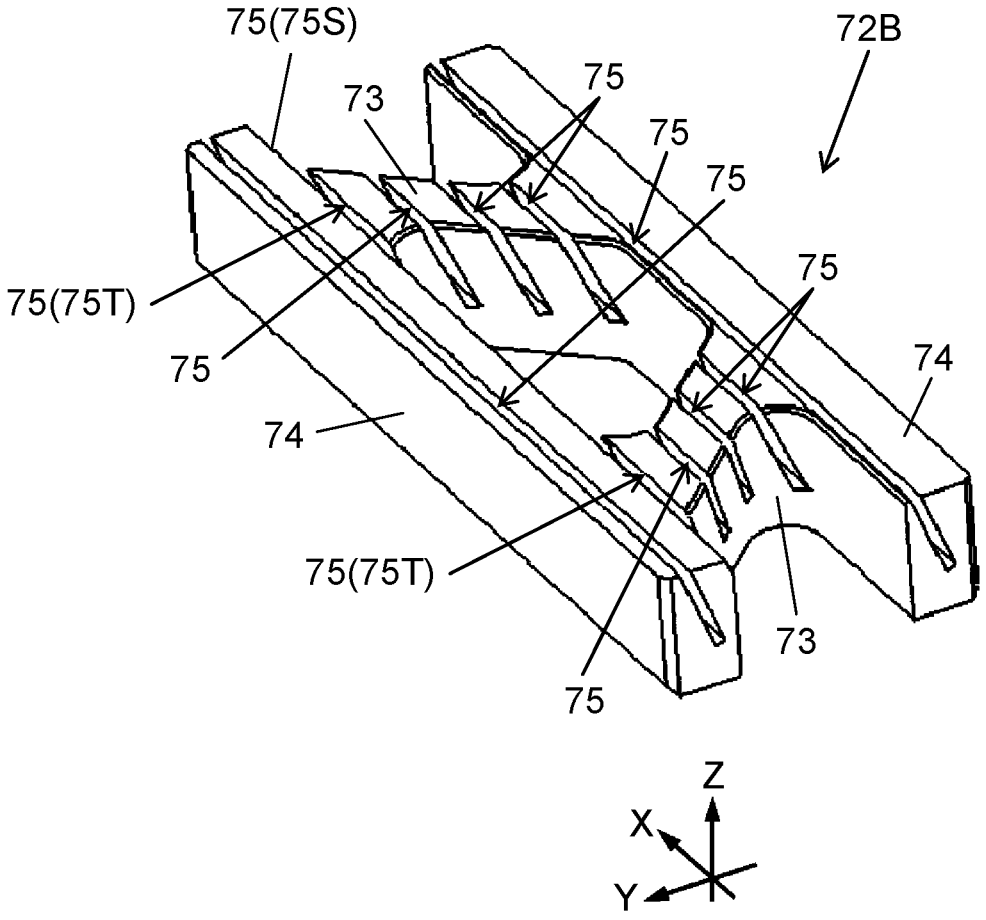
FIG. 11 is a perspective view of a block member forming a base portion of a mask cleaner included in a screen printing apparatus according to an embodiment of the present disclosure.
Figure 12:
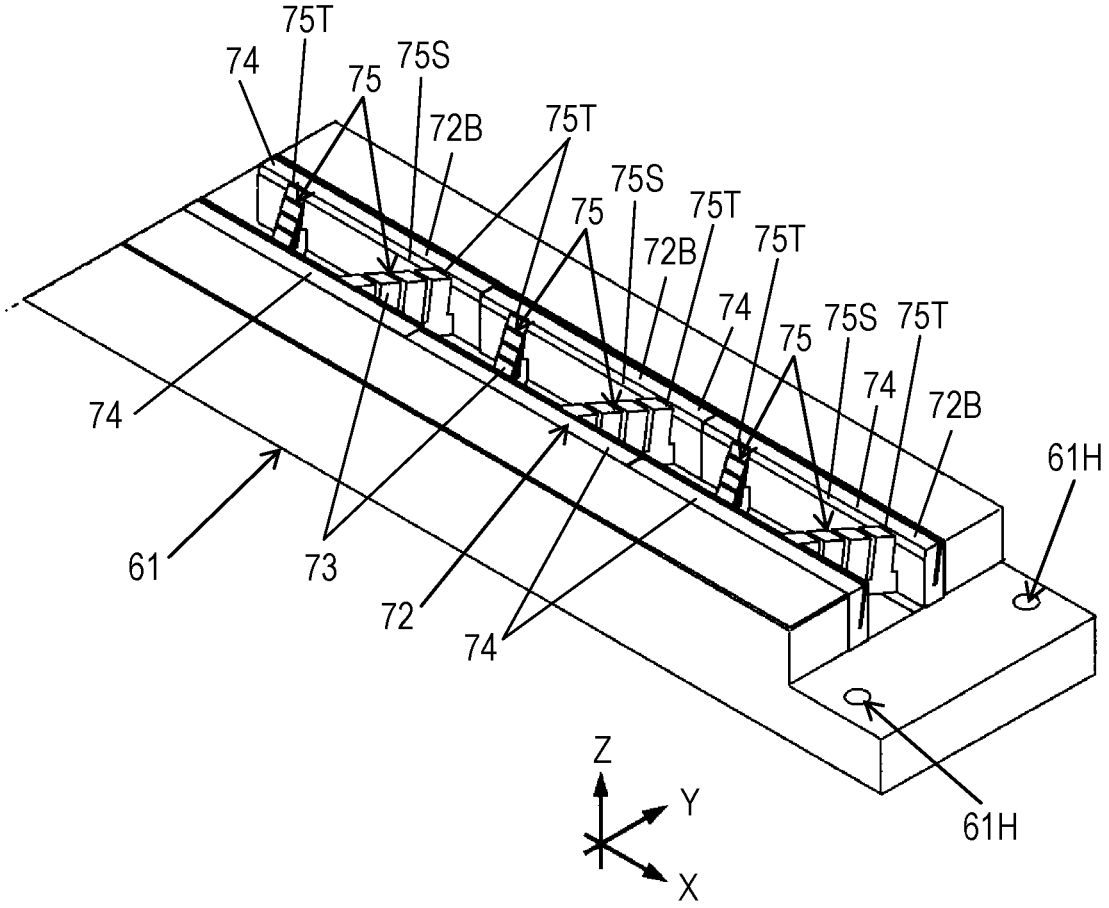
FIG. 12 is a perspective view of a part of a base portion of a mask cleaner included in a screen printing apparatus according to an embodiment of the present disclosure.

In FIGS. 10, 11, and 12, blade holder 72 (each block member 72B) includes a pair of parallel edges 74 extending in the longitudinal direction (X axis direction) of base body 61 and opposed in the paste scraping direction (Y axis direction), and plurality of beams 73 extend and bridge between the pair of edges 74. Blade holder 72 (that is, each block member 72B) is mounted to frame 71, with the pair of edges 74 being placed on a pair of block supports 71B formed inside opening 71S of frame 71 (FIGS. 8A and 8B).

When blade holder 72 (seven block members 72B) is mounted to frame 71, plurality of beams 73 are equally spaced in the longitudinal direction (X axis direction) of base body 61 (equal intervals when viewed from the intermediate position in the paste scraping direction of each beam 73) (FIGS. 6 and 9). In addition, each of plurality of beams 73 obliquely intersects in the horizontal plane with respect to the paste scraping direction (Y axis direction) (slightly inclined from the orthogonal orientation with respect to the longitudinal direction of base body 61) (FIGS. 5A and 10). Therefore, plurality of blades 62 are supported by beams 73 at different portions from each other in the longitudinal direction, such that, when viewing mask cleaner 16 from the paste scraping direction, the portions of respective blades 62 supported by beams 73 and the portions of respective blades 62 not supported by beams 73 are substantially evenly distributed in the longitudinal direction of blade 62.

In FIGS. 10, 11 and 12, a plurality of rows (here, six rows) of grooves 75 for receiving a plurality of blades 62 to be inserted therein are provided in blade holder 72, which extend in the longitudinal direction of base body 61, respectively. In the present embodiment, each of two edges 74 at the front and rear sides in a traveling direction (here, the forward side) of mask cleaner 16 during scraping of paste Pst is provided with one groove 75 (one row), and plurality of beams 73 are provided with four rows of grooves 75. These four rows of grooves 75 are provided across a plurality of beams 73 arranged at intervals in the longitudinal direction of base body 61 (FIGS. 10 and 11).

In FIGS. 10, 11 and 12, each groove 75 is opened upward. The plurality of rows (six rows) of grooves 75 provided in blade holder 72 are parallel to each other, and is inclined at each upper end side that is in a direction opposite to the traveling direction of mask cleaner 16 (in other words, inclined at a rearward side) during scraping of paste Pst.

Figure 4:
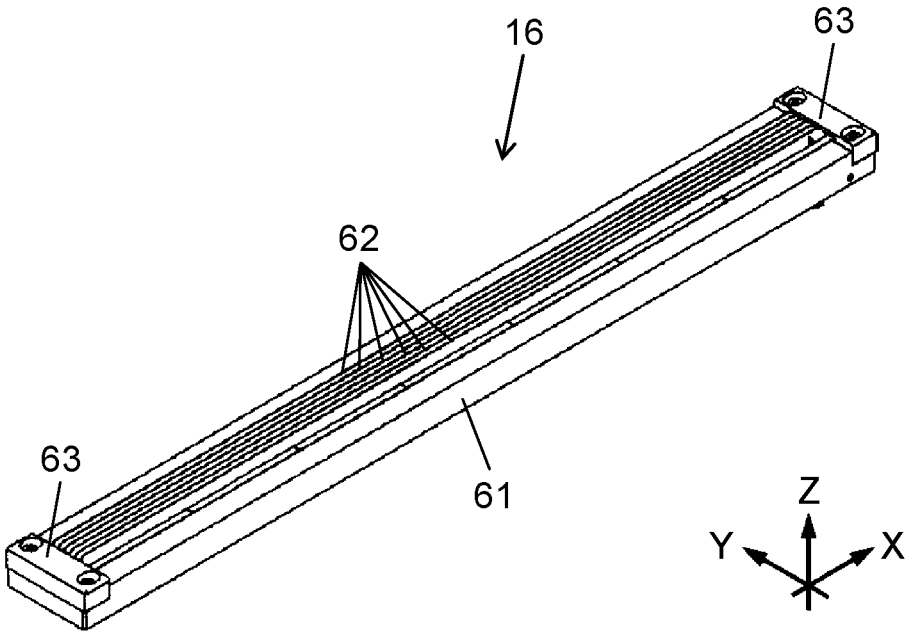
FIG. 4 is a perspective view of a mask cleaner included in a screen printing apparatus according to an embodiment of the present disclosure.
Figure 13:
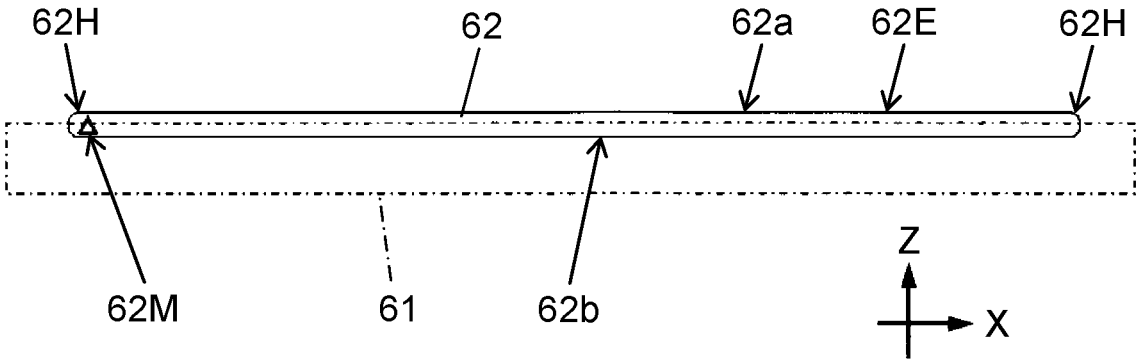
FIG. 13 is a side view of a blade of a mask cleaner included in a screen printing apparatus according to an embodiment of the present disclosure.
Figure 14:
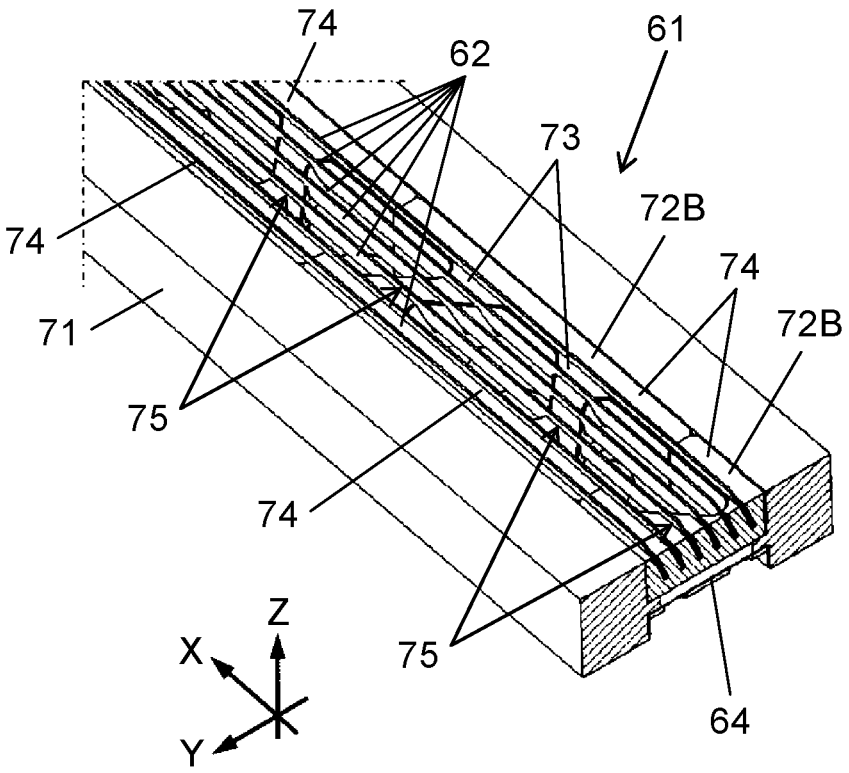
FIG. 14 is a perspective view of a part of a mask cleaner included in a screen printing apparatus according to an embodiment of the present disclosure.

In FIGS. 6 and 13, each blade 62 is a thin plate-like member extending in a longitudinal direction of base body 61, and is formed of resin. As shown in FIG. 14, six blades 62 are inserted into the six rows of grooves 75 provided in blade holder 72 from above. Therefore, plurality of blades 62 supported by blade holder 72 are arranged in parallel with each other in the paste scraping direction (FIGS. 4, 5A, and 14).

In FIGS. 8A and 8B, two of six blades 62 are supported by the two rows of grooves 75 located at both front and rear ends of mask cleaner 16 in the traveling direction of mask cleaner 16 (to the right side on the drawing sheet of FIGS. 8A and 8B) during scraping of paste Pst. The other four blades 62 out of six blades 62 are supported by the four rows of grooves 75 provided in blade holder 72. That is, when viewed from the traveling direction, two blades 62 located at the leading and trailing ends are supported by grooves 75 provided in edges 74. Four blades 62 located in between are supported by grooves 75 provided in beam 73. As described above, since the upper end sides of respective grooves 75 are inclined rearward, respective blades 62 inserted into grooves 75 are in a posture in which the upper end side is inclined rearward in opening 71S.

Here, groove 75T receiving therein blade 62 located at the rearmost side (indicated by reference numeral 62T in FIGS. 8A and 8B) among four middle blades 62 is opened on the upper surface of the rearward side edge 74. As a result, inclined sealing surface 75S having a length substantially the same as blade 62 is formed along edge 74 at the upper end of groove 75T. As clearly shown in FIG. 12, this sealing surface 75S is also formed on the upper portion of edge 74 without beam 73. Therefore, the rear surface of blade 62T inserted into groove 75T is in abutment against sealing surface 75S.

In FIGS. 8A and 8B, since the intermediate portion of each of four middle blades 62 in the longitudinal direction is partially supported by plurality of beams 73, portions protruding from beams 73 are located in openings 71S. Therefore, spaces 62S defined by leading blade 62 and four middle blades 62 are communicated with opening 71S. On the other hand, blade 62 located at the rearmost side in the traveling direction of mask cleaner 16 is supported by blade holder 72 in its entire longitudinal direction, and a rear surface of blade 62T that is located next to rearmost blade 62 in the forward direction is in abutment against sealing surface 75S so that space 62ST defined by blade 62 located at the rearmost side in the traveling direction and blade 62T located next to rearmost blade 62 in the forward direction is blocked from opening 71S. Since blade 62 located at the frontmost side in the traveling direction of mask cleaner 16 is also located outside opening 71S, the space on the side of the paste scraping surface thereof is also blocked from opening 71S.

As described above, mask cleaner 16 according to the present embodiment includes base body 61 which is mounted to moving base 55, including a longitudinal side, the longitudinal side being horizontal and intersecting the paste scraping direction and paste scraping edges 62E which are removably mounted to base body 61, extending in the longitudinal direction, and are arranged side by side in parallel to the scraping direction of the paste, and protruded upward from base body 61. Base body 61 includes frame 71 having opening 71S opened upward and blade holder 72 having a plurality of beams 73 mounted to opening 71S of frame 71 and arranged at intervals in the longitudinal direction, in which blade holder 72 holds a plurality (six pieces) of blades 62, and plurality of beams 73 (four blades 62 except two blades 62 located at the frontmost side and the rearmost side in the traveling direction of mask cleaner 16 among six blades 62) partially support the intermediate portion in the longitudinal direction of blade 62.

In addition, in mask cleaner 16 according to the present embodiment, among plurality of spaces 62S defined by blades 62, at least space 62ST located at the rearmost side of mask cleaner 16 in the traveling direction is not communicated with opening 71S during scraping of paste Pst.

In FIGS. 4, 5A, 5B, 5C, 6 and 9, the pair of end members 63 are mounted to both end portions of base body 61 in the longitudinal direction (Y axis direction). Each of end members 63 is formed of resin and includes two screw holes 63H formed side by side in the paste scraping direction (Y axis direction). Each end member 63 is detachably mounted to base body 61 as two screws 63S are threaded into two screw holes 63H and then into screw engagement holes 61H (FIG. 6) provided at both end portions of base body 61 in the longitudinal direction. End member 63 includes flat upper surface 63F extending in the XY direction.

In FIG. 13, pressed portions 62H are formed at both end portions of each blade 62 in the longitudinal direction. Pressed portion 62H has a horizontally symmetrical semicircular shape, which is protruded outward in the longitudinal direction of blade 62. When the pair of end members 63 are mounted to both end portions of base body 61, protrusions 63T of end members 63 (FIGS. 15A and 15B) are abutted against the inclined surface (here, circular arc surface) of pressed portion 62H of each of plurality of blades 62 from above, and plurality of blades 62 are fixed to frame 71.

As described above, in the present embodiment, each of plurality of blades 62 includes a pair of pressed portions 62H formed by protruding both end portions thereof in the longitudinal direction outward in the longitudinal direction, and the pair of pressed portions 62H included in each of plurality of blades 62 are adapted to be pressed by a pair of end members 63 that are detachably mounted to base body 61 from above.

Pair of end members 63 mounted to base body 61 are brought into contact with both end portions of pressed portions 62H of plurality of blades 62, so that side walls are formed between blades 62 adjacent to each other in the paste scraping direction (Y axis direction). Therefore, at the time of air suction which will be described below, inflow of air from the side of space 62S defined by blades 62 is prevented. The shape of pressed portion 62H of blade 62 is not limited to a semicircular shape that has horizontally symmetrical shape as shown in FIG. 13, but may have a semi-elliptical shape, a triangular shape, a trapezoidal shape, or the like horizontally symmetrical.

When plurality of blades 62 are fixed to frame 71 by the pair of end members 63, the upper edges of each of plurality of blades 62 protrude upward from the upper surfaces of the respective end members 63 (FIGS. 8A, 8B, 15A, and 15B). That is, the upper surfaces of each end member 63 mounted to base body 61 is located lower than the upper edge of plurality of blades 62. The upper edge protruding upward from base body 61 is an edge (paste scraping edge 62E) that will be abutted against lower surface of mask 13 to scrape off paste Pst during cleaning of mask 13 (FIG. 13).

In FIG. 13, each blade 62 has a horizontally symmetrical shape, and includes two edges (first edge 62*a* and second edge 62*b*) opposed in the vertical direction. Therefore, each blade 62 may be mounted to base body 61, so that any one edge (first edge 62*a* or second edge 62*b*) can be paste scraping edge 62E (FIGS. 15A and 15B).

Figure 15A:
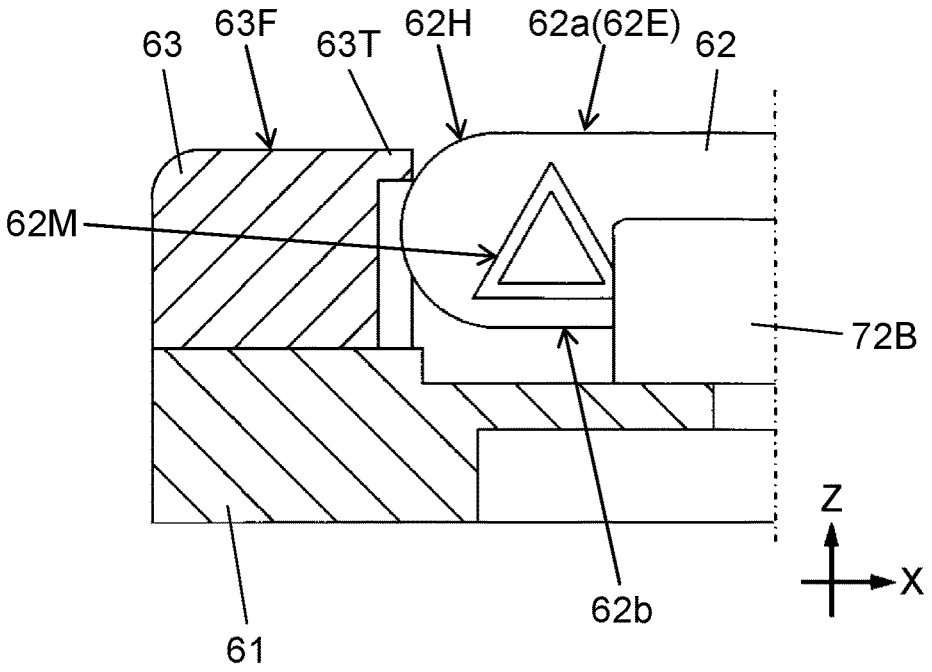
FIG. 15A is an enlarged side view of a part of a blade of a mask cleaner included in a screen printing apparatus according to an embodiment of the present disclosure.
Figure 15B:
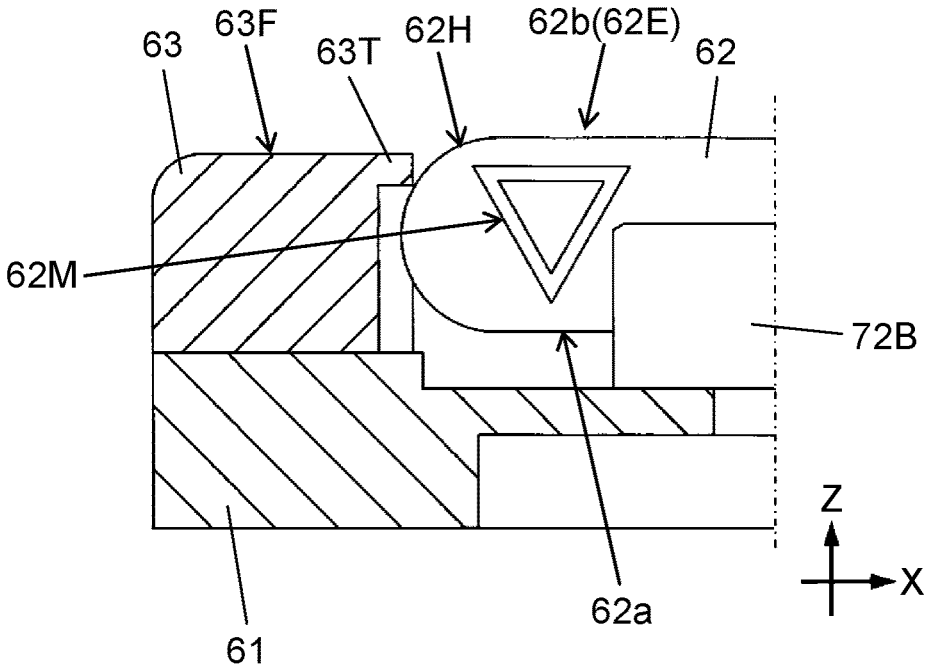
FIG. 15B is an enlarged side view of a part of a blade of a mask cleaner included in a screen printing apparatus according to an embodiment of the present disclosure.
Figure 16:
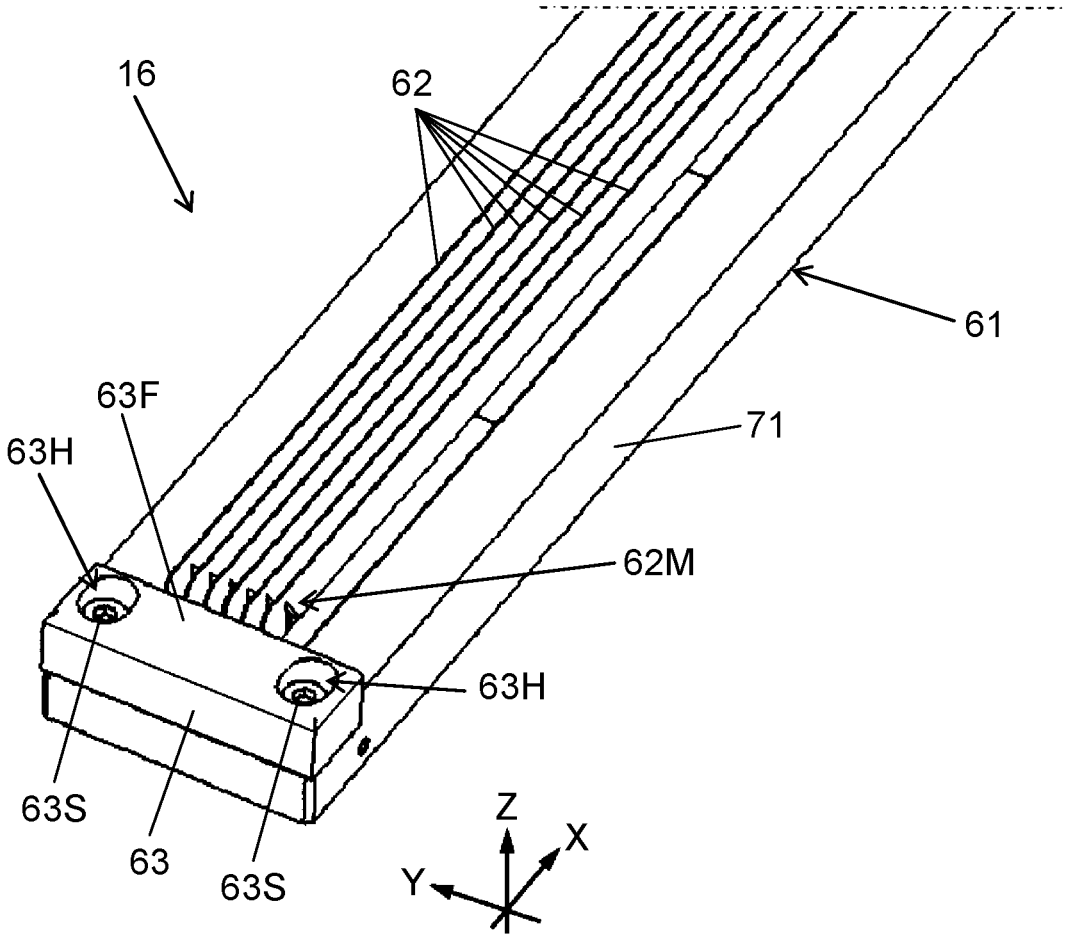
FIG. 16 is a perspective view of a part of a mask cleaner included in a screen printing apparatus according to an embodiment of the present disclosure.

As shown in FIGS. 15A and 15B, identification mark 62M (identification mark) for identifying first edge 62*a* and second edge 62*b* is mounted to the end portion of each blade 62 (see also FIGS. 13 and 16). Identification mark 62M may be visually recognized from the outside in a state that blade 62 is mounted to base body 61 (FIG. 16). Therefore, the operator may confirm which of first edge 62*a* and second edge 62*b* of blade 62 is paste scraping edge 62E without having to disassemble blade 62 from base body 61.

Figure 5B:
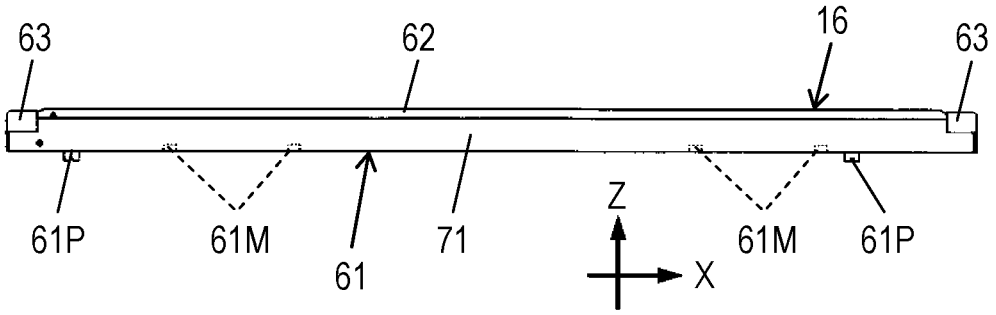
FIG. 5B is a side view of a mask cleaner included in a screen printing apparatus according to an embodiment of the present disclosure.
Figure 5C:
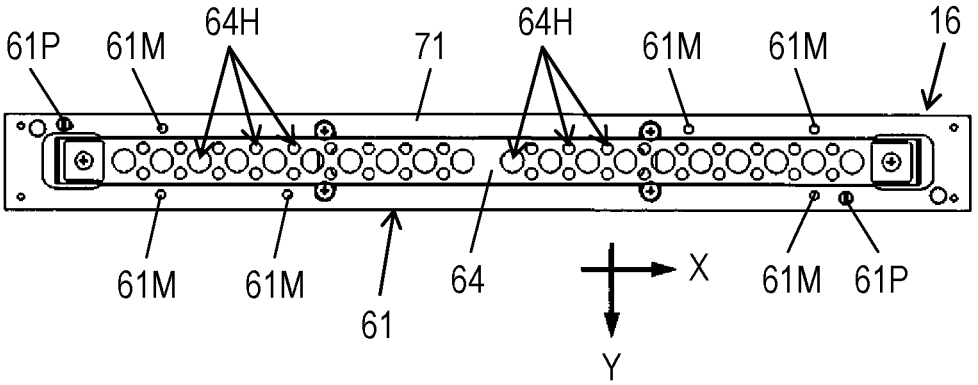
FIG. 5C is a bottom view of a mask cleaner included in a screen printing apparatus according to an embodiment of the present disclosure.

In FIGS. 5C, 6 and 14, straightening vane 64 is provided on the lower surface side of base body 61. Straightening vane 64 includes a plurality of straightening holes 64H arranged side by side in the longitudinal direction of base body 61 and is detachably mounted to base body 61 by a plurality of straightening vane mounting screws 64S (FIGS. 6, 8A, and 8B).

In FIG. 6, a plurality (here, two pieces) of positioning holes 55H are provided in a portion of the upper surface of moving base 55 which is in contact with the lower surface of base body 61. On the other hand, on the lower surface of frame 71 forming base body 61, a plurality (here, two pieces) of positioning pins 61P are disposed corresponding to plurality of positioning holes 55H, extend downward (FIGS. 5B and 5C). Plurality of positioning pins 61P are provided for positioning base body 61 with respect to moving base 55.

Figure 17A:
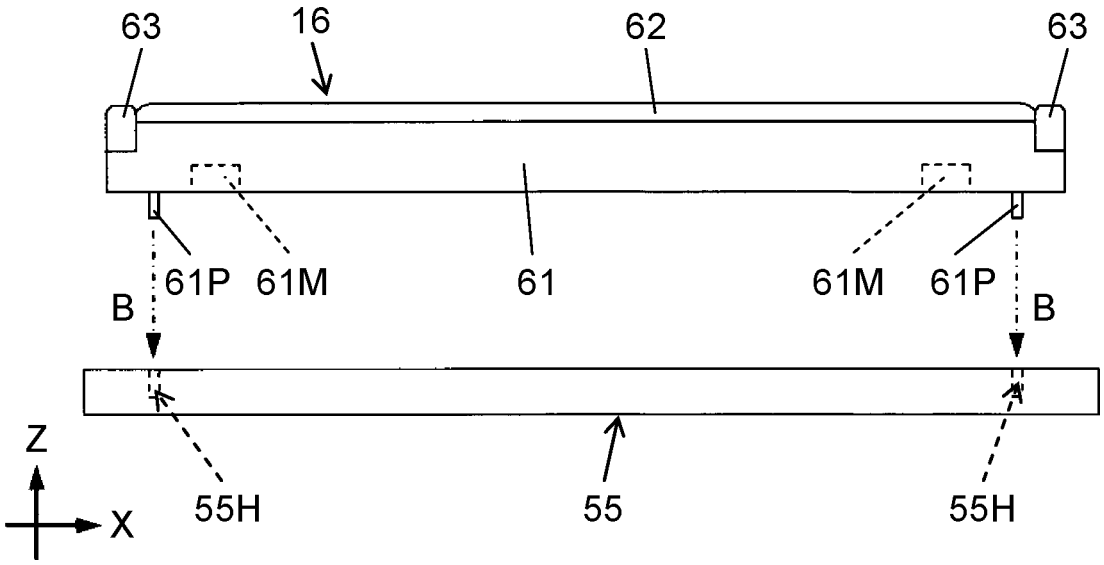
FIG. 17A is a view for explaining a procedure of mounting a mask cleaner included in a screen printing apparatus to a moving base, according to an embodiment of the present disclosure.
Figure 17B:
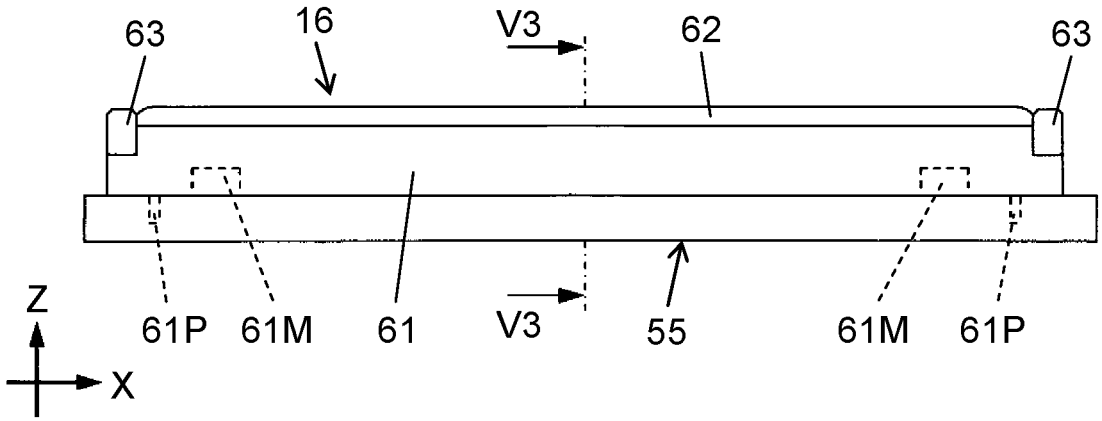
FIG. 17B is a view for explaining a procedure of mounting a mask cleaner included in a screen printing apparatus to a moving base, according to an embodiment of the present disclosure.

When mask cleaner 16 is mounted to moving base 55, a plurality of positioning pins 61P provided on base body 61 of mask cleaner 16 are inserted into a plurality of positioning holes 55H provided in moving base 55 from above (see arrow B shown in FIG. 17A), so that mask cleaner 16 is mounted to a specified position on moving base 55 (FIG. 17B).

In FIGS. 5B, 5C, 8A and 8B, a plurality of magnets 61M are buried in base body 61, with the lower surfaces thereof being exposed. On the other hand, moving base 55 is formed of a magnetic material. Therefore, when mask cleaner 16 is mounted to the specified position on moving base 55, plurality of magnets 61M buried in frame 71 are adsorbed onto the upper surface of moving base 55 by magnetic force and mask cleaner 16 is fixed to moving base 55 (FIG. 17B).

Figure 18:
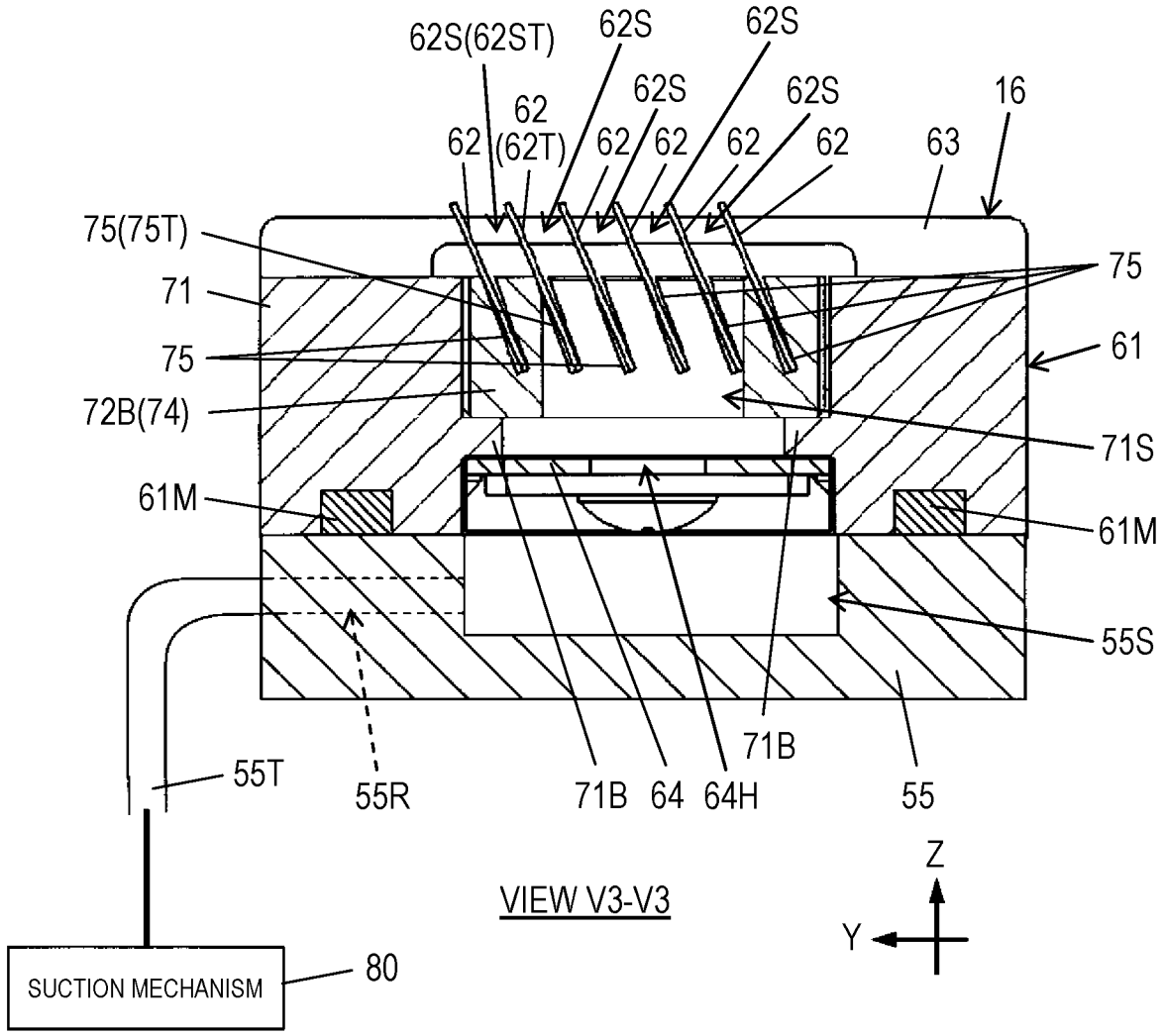
FIG. 18 is a side sectional view of a mask cleaner and a moving base included in a screen printing apparatus according to an embodiment of the present disclosure.

When mask cleaner 16 is mounted to moving base 55 in FIG. 18 (a sectional view taken along the arrow V3-V3 in FIG. 17B), opening 71S of mask cleaner 16 is communicated with inner space 55S formed in moving base 55 (see also FIG. 6). Moving base 55 is provided with vacuum suction conduit 55T extending to the outside through air passage 55R (see also FIG. 6) provided in inner space 55S (FIGS. 3 and 18). Suction mechanism 80 is connected to vacuum suction conduit 55T (FIGS. 3 and 18), and when suction mechanism 80 sucks air through vacuum suction conduit 55T, the air above mask cleaner 16 is drawn into inner space 55S through opening 71S and straightening hole 64H provided in straightening vane 64, and paste Pst adhering to lower surface of mask 13 and pattern hole 13H is sucked out to the direction of mask cleaner 16.

When screen printing apparatus 1 performs a screen printing operation, first, transfer conveyor 31 receives board KB supplied from the outside of screen printing apparatus 1 and carries-in board KB to a predetermined position. Then, lower receiver 32 is lifted to support board KB from below, and then damper 33 is operated to clamp board KB from the Y axis direction. When damper 33 clamps board KB, camera 15 images mask 13 and board KB while being moved in the horizontal direction by the operation of Y axis direction moving mechanism 52 and X axis direction moving mechanism 53. Controller 20 calculates the relative positional relationship between board KB and mask 13 obtained from the image data of board KB and mask 13 imaged by camera 15, and board holder moving mechanism 22 is operated and board KB is brought into contact with mask 13, so that each land LD of board KB and pattern hole 13H of mask 13 are vertically overlapped with each other.

When board KB comes into contact with mask 13, squeegee lifting driver 43 is operated to move one of two squeegees 42 into abutment against the upper surface of mask 13. When squeegee 42 is abutted against the upper surface of mask 13, print head moving mechanism 44 moves head base 41 in the Y axis direction. As a result, paste Pst supplied onto mask 13 is scraped off from mask 13 by squeegee 42 (FIG. 2), and paste Pst is applied to each land LD of board KB through pattern hole 13H of mask 13.

When paste Pst is applied to each land LD of board KB, board holder moving mechanism 22 lowers board holder 21 to separate from mask 13 (release board KB). As a result, printing paste Pst onto board KB is completed. When printing paste Pst onto board KB is completed, transfer conveyors 31 are operated to carry-out board KB to the outside of screen printing apparatus 1.

Figure 19A:
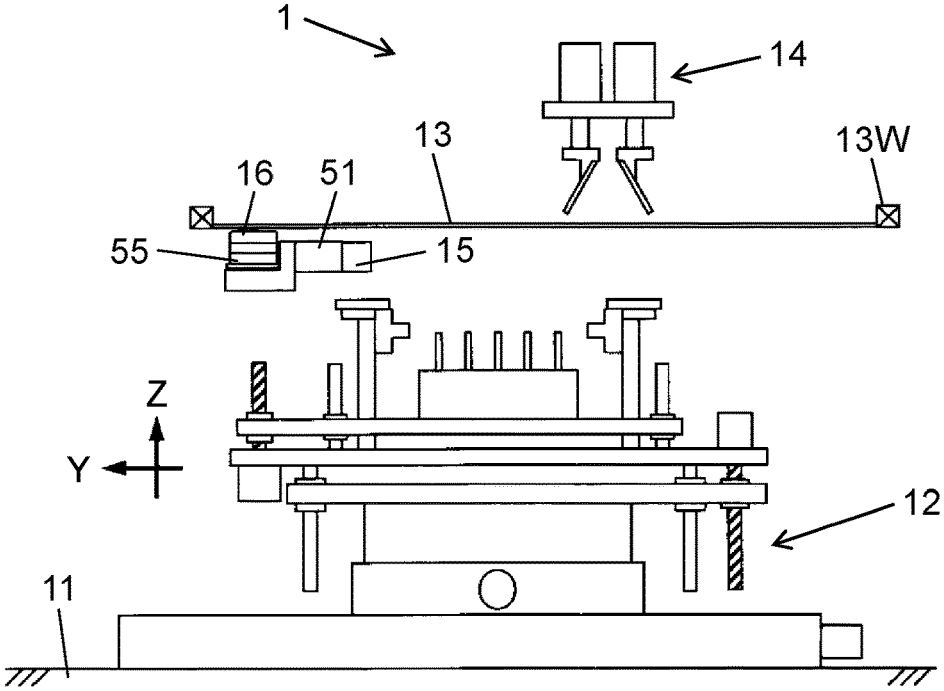
FIG. 19A is a view for explaining an operation of a screen printing apparatus according to an embodiment of the present disclosure.

When board KB is carried-out to the outside of screen printing apparatus 1 by transfer conveyors 31, the mask cleaning operation is performed by mask cleaner 16. In the mask cleaning operation, Y axis direction moving mechanism 52 moves moving beam 51 in the Y axis direction and positions mask cleaner 16 at the rear lower side of mask 13. When mask cleaner 16 is located at the rear lower side of mask 13, lifting mechanism 54K is operated to lift mask cleaner 16 (specifically, paste scraping edge 62E of six blades 62) into abutment against lower surface of mask 13 (FIG. 19A).

Figure 19B:
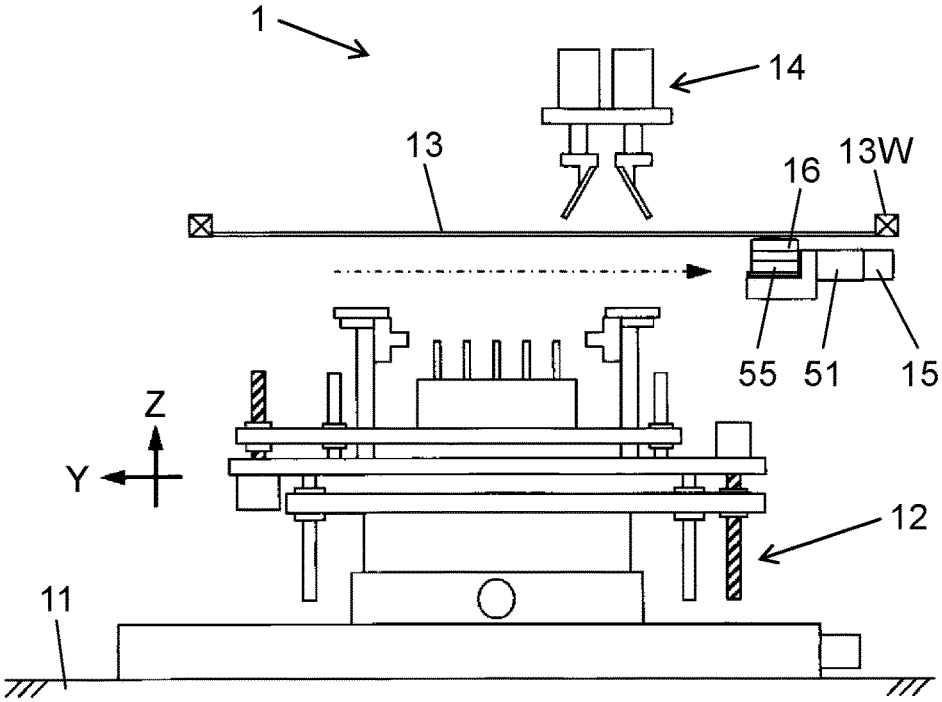
FIG. 19B is a view for explaining an operation of a screen printing apparatus according to the embodiment of the present disclosure.
Figure 20:
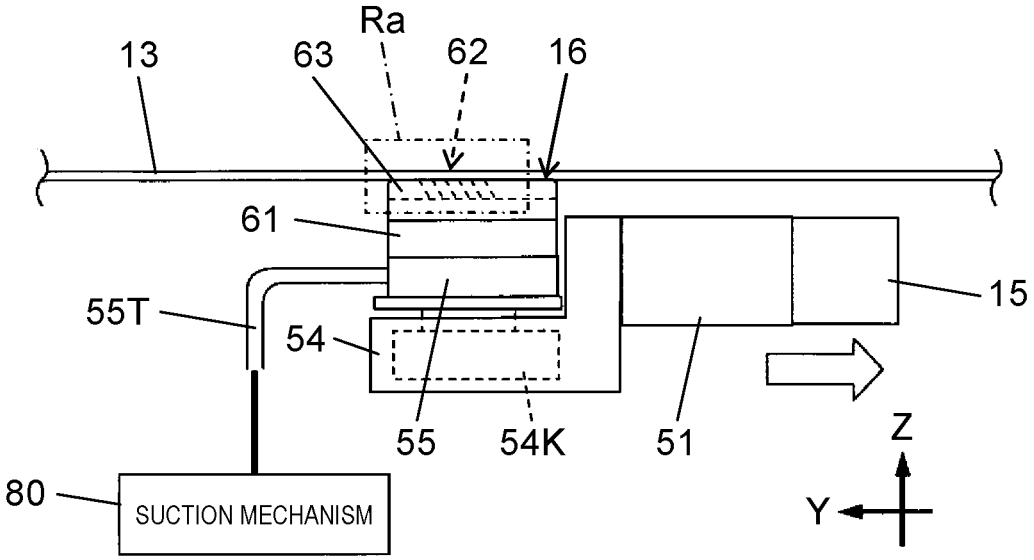
FIG. 20 is a view showing a state in which a lower surface of a mask is cleaned by a mask cleaner included in a screen printing apparatus, according to an embodiment of the present disclosure.

When mask cleaner 16 is abutted against lower surface of mask 13, Y axis direction moving mechanism 52 is operated to move moving beam 51 forward. As a result, six blades 62 of mask cleaner 16 are slid on lower surface of mask 13, and paste Pst adhering to lower surface of mask 13 is scraped off by paste scraping edge 62E of each blade 62 (FIGS. 19B and 20). While six blades 62 scrape off paste Pst adhering to lower surface of mask 13, suction mechanism 80 sucks air. As a result, paste Pst adhering to mask 13 is forcibly sucked out by suction mechanism 80 through opening 71S of mask cleaner 16 and plurality of spaces 62S defined by blades 62, so that the scraping efficiency of paste Pst is improved.

Figure 21:
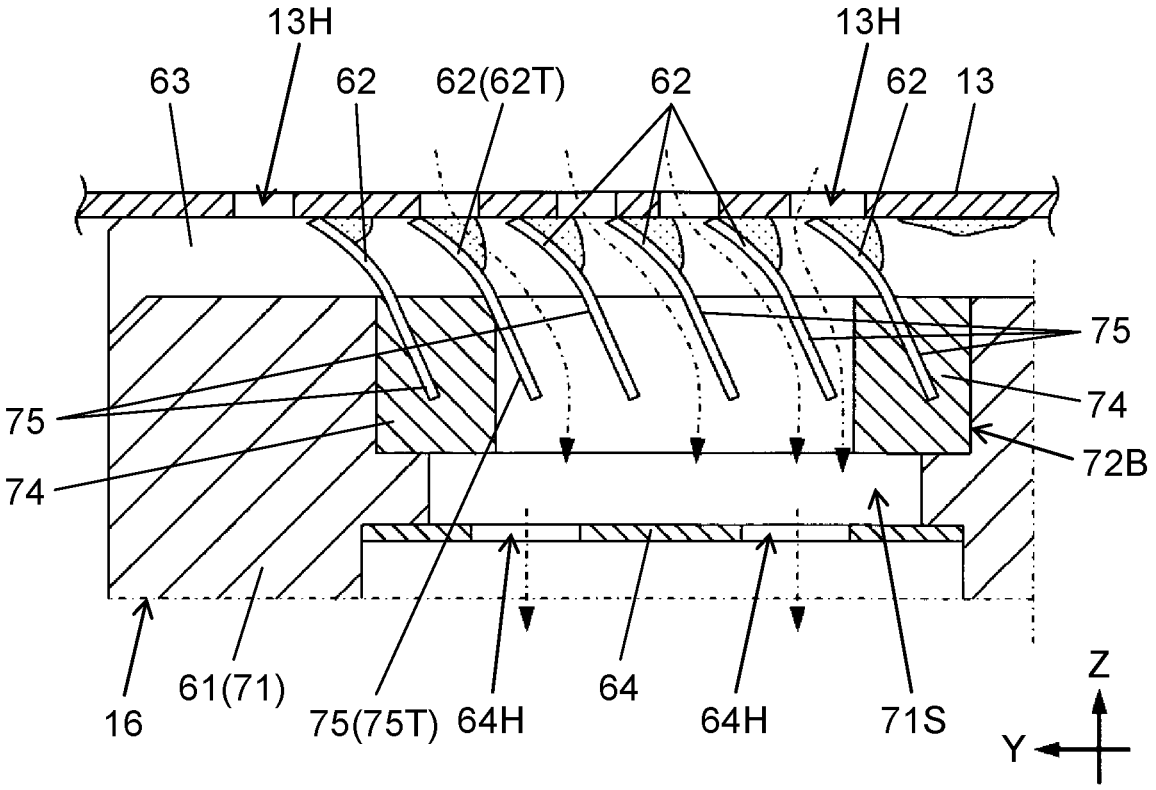
FIG. 21 is a view showing a state in which a lower surface of the mask is cleaned by a mask cleaner included in a screen printing apparatus according to an embodiment of the present disclosure.

When blades 62 are slid on lower surface of mask 13, performing the mask cleaning in this way, the pair of end members 63 mounted to base body 61 are moved into abutment against lower surface of mask 13 from below as shown in FIG. 21 which is an enlarged view of region Ra shown in FIG. 20. Therefore, air is prevented from flowing into opening 71S from the side of space 62S defined by blades 62 during mask cleaning. As a result, it is possible to prevent the suction force of mask cleaner 16 from being diminished by the air flowing in from elsewhere that do not contribute to cleaning.

In FIG. 21, in the scraping of paste Pst in the mask cleaning, among six blades 62 arranged side by side in the paste scraping direction, blade 62 located at the frontmost side in the traveling direction of mask cleaner 16 scrapes off paste Pst adhering to lower surface of mask 13 earlier than the other blades 62 during scraping off paste Pst. Therefore, the amount of scraped paste Pst is the largest at blade 62 located at the frontmost position in the traveling direction of mask cleaner 16 during scraping of paste Pst, and the amount of scraping is gradually decreased along the rest five blades 62 which are located further rearward.

In addition, during scraping of paste Pst, each of blades 62 located behind blade 62 located at the frontmost position in the traveling direction of mask cleaner 16 also scrapes off paste Pst that is sucked out by suction mechanism 80 from pattern hole 13H immediately before that blade 62. When paste Pst is not scraped off by that blade 62, then it is scraped off by blade 62 located behind that blade 62.

As the mask cleaning is repeated, the amount of paste Pst adhering to blade 62 that is to be scraped gradually increases, and the performance of blades 62 to scrape off paste Pst also decreases as the amount of adhering paste Pst increases. Therefore, a plurality of blades 62 are used to maintain cleaning efficiency as long as possible. In addition, it is contemplated to maintain the cleaning performance further longer by reducing the amount of the adhering paste Pst for blade 62 that is located at the rearmost side in the traveling direction of mask cleaner 16 in this embodiment.

In the present embodiment, as described above, during scraping of paste Pst, space 62ST between blade 62 located at the rearmost side in the traveling direction of mask cleaner 16 and blade 62T located next to rearmost blade 62 in the forward direction, among six blades 62 arranged side by side in the paste scraping direction, is blocked from opening 71S, and the suction force of suction mechanism 80 is hardly applied thereto. Therefore, in space 62ST, no air flow for moving paste Pst remaining inside pattern hole 13H to lower surface of mask 13 is generated.

Therefore, paste Pst forcibly sucked out by suction mechanism 80 does not flow into the paste scraping surface of blade 62 located at the rearmost side in the traveling direction among six blades 62, and the amount of paste Pst scraped off by blade 62 located at the rearmost side is smaller than that of the other blades 62. In other words, since paste Pst remaining inside pattern hole 13H does not flow into space 62ST located at the rearmost side in the traveling direction, blade 62 located at the rearmost side is only required to scrape off only a small amount of paste Pst which is not scraped off by blade 62T that is located next to it in the forward direction. Therefore, blade 62 located at the rearmost side may be more likely to be kept from being contaminated with paste Pst than the other blades 62 located at the forward side thereof, while paste Pst which is not scraped off by front blade 62 may be reliably scraped off.

As a result, compared with the related art, it is possible to maintain the cleaning performance for a long period of time, and also reduce the number of cleaning times of the cleaning units and the like and reduce the subsequent operation stoppage time of the cleaning printing apparatus.

In such screen printing apparatus 1, since each blade 62 is contaminated by the scraped paste Pst, it is necessary to perform cleaning at a predetermined timing. Blade 62 is disassembled from base body 61 to be cleaned, and in this embodiment, since blade 62 is formed of resin as described above, the plastic deformation does not occur even when blade 62 is excessively bent by mistake during cleaning of blade 62, and there is no possibility that paste scraping edge 62E does not come into contact with lower surface of mask 13 after cleaning (after being assembled back to base body 61). Therefore, it is possible to prevent deterioration of the cleaning quality caused by deformed blade 62 that may be deformed while blade 62 is being cleaned or the like. Since an alcohol solvent capable of dissolving paste Pst is used for cleaning blade 62, it is preferable that blade 62 is formed of a kind of resin that has high durability against an alcohol-based solvent.

Further, in the present embodiment, blade 62 has a horizontally symmetrical shape, such that any one of the two edges (first edge 62*a* and second edge 62*b*) opposed to each other in the vertical direction may be used as paste scraping edge 62E. Therefore, when one of first edge 62*a* and second edge 62*b* reaches the durability limit of scraping off paste Pst, blade 62 is disassembled from base body 61 and is reversed upside down to be reassembled back into base body 61, so that blade 62 may be used again up to the durability limit. As described above, in mask cleaner 16 according to the present embodiment, the lifetime of blade 62 may be increased (doubled), and the cost may be reduced.

Here, as described above, since identification mark 62M is mounted to each blade 62 as an identification mark for identifying first edge 62*a* and second edge 62*b*, the operator may accurately confirm the condition of blade 62 (that is, whether it is before or after blade 62 is reversed upside down) by comparing identification mark 62M with the order of use of first edge 62*a* and second edge 62*b* which are determined in advance. In the present embodiment, identification mark 62M exemplifies a triangular figure whose apex angle is directed toward first edge 62*a* (FIGS. 15A and 15B), but this is merely an example, and the form of identification mark 62M is not limited.

Plurality of beams 73 included in blade holder 72 of mask cleaner 16 extend obliquely in a horizontal plane with respect to the paste scraping direction (Y axis direction), respectively, and plurality of blades 62 are supported by beams 73 at portions different from each other in the longitudinal direction. Therefore, when mask 13 is cleaned, the portions supported by beams 73 of each blade 62 and the portions not supported by beams 73 are dispersed in the longitudinal direction of blade 62, and the degree of contact of blade 62 with respect to mask 13 is kept uniform across the entire mask cleaner 16. As a result, the streaks corresponding to the position of beams 73 do not remain on lower surface of mask 13, and therefore, the quality of the cleaning may be improved.

Further, in the present embodiment, since blade holder 72 includes plurality of block members 72B that have the same shape and are detachably mounted to frame 71, the cleaning of blade holder 72 becomes extremely easy during the cleaning base body 61 performed in conjunction with the cleaning of blade 62.

In many cases, blade holder 72 is cleaned by using an ultrasonic washing machine or the like, and since the cleaning tank may only have to have a certain size to accommodate at least one block member 72B, the ultrasonic cleaning machine may be small in size, thereby reducing the cost required for cleaning.

In addition, as described above, the amount of paste Pst to be scraped off by blade 62 located at the rearmost side is smaller than that by the other blades 62, while paste Pst remaining after scraping off by the other blades 62 located in the forward side of the rearmost blade may be reliably scraped off, thereby improving the cleaning quality of mask 13. Furthermore, since it is not highly likely that paste Pst would remain for scraping by blade 62 located at the rearmost side, paste Pst remaining on the bottom surface of mask 13 may be suppressed to an extremely small amount, and in view of this, the cleaning quality of mask 13 can also be improved.

Moving base 55 to which mask cleaner 16 is mounted is formed of a magnetic material, and base body 61 of mask cleaner 16 is provided with magnets 61M which are adsorbed onto the upper surface of moving base 55 by magnetic force. Therefore, mask cleaner 16 may be mounted to and detached from moving base 55 with a single operation, which may improve the workability at the time of maintenance and repair, and the like.

In addition, as described above, while the mask is being cleaned, upper surface 63F of the pair of end members 63 mounted to base body 61 is in abutment against lower surface of mask 13 from below, so that the inflow of air from the side of the spaces 62S defined by blades 62 is prevented, and paste Pst may be efficiently sucked out when the mask is being cleaned. Therefore, the cleaning quality can also be improved in view of this. In addition, end members 63 serve as a stopper for preventing blade 62 from being pressed against mask 13 with an excessive force. That is, since lower surface of mask 13 comes into contact with upper surface 63F of end members 63, the deformation of blade 62 is maintained within a certain range, and the progress of wear of blade 62 is controlled within a preset range.

As described above, in screen printing apparatus 1 according to the present embodiment, since blade 62 of mask cleaner 16 is formed of resin, when blade 62 is disassembled from base body 61 to be cleaned, even when the operator inadvertently bends blade 62 more than necessary, blade 62 is not plastically deformed. Therefore, it is possible to avoid situations where paste scraping edge 62E does not come into contact with lower surface of mask 13, and also prevent deterioration of cleaning quality due to bending of blade 62.

Further, in screen printing apparatus 1 according to the present embodiment, blade 62 has a horizontally symmetrical shape, and any one of the two edges (first edge 62*a* and second edge 62*b*) opposed to each other in the vertical direction may be used as paste scraping edge 62E. Therefore, it is possible to increase (double) the service life and reduce the cost by reversing blade 62 upside down and using it.

Although the embodiments of the present disclosure have been described above, the present disclosure is not limited to those described above. For example, in the embodiments described above, the number of blades 62 provided in mask cleaner 16 is six, but this is merely an example, and the number of blades 62 is not particularly limited thereto. Although print head 14 for printing paste Pst onto board KB through mask 13 has a configuration in which squeegees 42 are slid on mask 13, it may be a configuration in which paste Pst enclosed in the cartridge is pressed out onto mask 13, for example.

In the embodiments described above, among the plurality (six pieces) of blades 62 supported by blade holder 72, blade 62 located at the frontmost side and blade 62 located at the rearmost side in the traveling direction of mask cleaner 16 during scraping of paste Pst are located outside opening 71S, but blade 62 located at the frontmost side may be located inside opening 71S. That is, it suffices that, among plurality of spaces 62S defined by blades 62, at least space 62S located at the rearmost side in the traveling direction of mask cleaner 16 during scraping of paste Pst is blocked from opening 71S.

In the embodiment described above, entire moving base 55 is formed of a magnetic material, but as long as it is adsorbed by the magnetic force by plurality of magnets 61M buried in base body 61, it will suffice that the portion including at least the upper surface of moving base 55 is formed of a magnetic material.

The present disclosure may be applied to a screen printing apparatus for printing a paste such as a solder paste or an adhesive onto a board by screen printing.

What is claimed is:

1. A screen printing apparatus comprising:

a print head that prints a paste onto a board through a mask, a moving base moving under the mask in a horizontal paste scraping direction corresponding to a first axis, and a mask cleaner mounted to the moving base and moving under the mask integrally with the moving base to scrape off the paste adhering to a lower surface of the mask, wherein the mask cleaner includes:

a base body mounted to the moving base and including a longitudinal side corresponding to a second axis, the longitudinal side being horizontal and intersecting the paste scraping direction, and a plurality of blades detachably mounted to the base body and extending in a longitudinal direction corresponding to the second axis and arranged side by side in parallel to the paste scraping direction, and causing a paste scraping edge protruding upward from the base body to come into abutment against the lower surface of the mask, and each of the plurality of blades is formed of resin and comprises opposing edges vertically spaced relative to each other and symmetrical about the second axis such that each of the opposing edges is configured to be mounted to the base body as the paste scraping edge, and wherein the base body includes a frame having an opening opened upward and a blade holder provided with a plurality of beams mounted in the opening and arranged at intervals in the longitudinal direction, the blade holder holds the plurality of blades, and the plurality of beams support an intermediate portion of the blade in the longitudinal direction.

2. The screen printing apparatus of claim 1, wherein the blade holder is provided with a plurality of rows of grooves into which the plurality of blades are inserted.

3. The screen printing apparatus of claim 1, wherein the blade holder includes a plurality of block members detachably mounted to the frame.

4. The screen printing apparatus of claim 3, wherein the plurality of block members have the same shape as each other.

5. The screen printing apparatus of claim 1, wherein each of the plurality of blades includes a pair of pressed portions protruding outward in the longitudinal direction from both end portions in the longitudinal direction, and the pair of pressed portions included in each of the plurality of blades are pressed by a pair of end members detachably mounted to the base body from above.

6. The screen printing apparatus of claim 5, wherein each of the pair of pressed portions included in each of the plurality of blades has a horizontally symmetrical arc shape.

7. The screen printing apparatus of claim 1, wherein each of the plurality of blades is provided with an identification mark for identifying a first edge and a second edge of the blade.

8. A mask cleaner provided in a screen printing apparatus for printing a paste onto a board through a mask, the mask cleaner being mounted to a moving base that moves in a horizontal paste scraping direction under the mask, wherein the horizontal paste scraping direction corresponds to a first axis, and wherein the mask cleaner moves under the mask integrally with the moving base to scrape off the paste adhering to a lower surface of the mask, the mask cleaner comprising:

a base body mounted to the moving base and including a longitudinal side corresponding to a second axis, the longitudinal side being horizontal and intersecting the paste scraping direction, and a plurality of blades detachably mounted to the base body, extending in a longitudinal direction corresponding to the second axis and arranged side by side in parallel to the paste scraping direction, and causing a paste scraping edge protruding upward from the base body to come into abutment against the lower surface of the mask, wherein each of the plurality of blades is formed of resin and comprises opposing edges vertically spaced relative to each other and symmetrical about the second axis such that each of the opposing edges is configured to be mounted to the base body as the paste scraping edge, and wherein the base body includes a frame having an opening opened upward and a blade holder that is provided with a plurality of beams mounted in the opening and arranged at intervals in the longitudinal direction, and the blade holder holds the plurality of blades, and the plurality of beams support intermediate portions of the blades in the longitudinal direction.

9. The mask cleaner of claim 8, wherein the blade holder is provided with a plurality of rows of grooves into which the plurality of blades are inserted.

10. The mask cleaner of claim 8, wherein the blade holder includes a plurality of blocks detachably mounted to the frame.

11. The mask cleaner of claim 10, wherein the plurality of block members have the same shape as each other.

12. The mask cleaner of claim 8, wherein each of the plurality of blades is provided with an identification mark for identifying a first edge and a second edge of the blade.

13. A mask cleaner provided in a screen printing apparatus for printing a paste onto a board through a mask, the mask cleaner being mounted to a moving base that moves in a horizontal paste scraping direction under the mask, wherein the horizontal paste scraping direction corresponds to a first axis, and wherein the mask cleaner moves under the mask integrally with the moving base to scrape off the paste adhering to a lower surface of the mask, the mask cleaner comprising:

a base body mounted to the moving base and including a longitudinal side corresponding to a second axis, the longitudinal side being horizontal and intersecting the paste scraping direction, and a plurality of blades detachably mounted to the base body, extending in a longitudinal direction corresponding to the second axis and arranged side by side in parallel to the paste scraping direction, and causing a paste scraping edge protruding upward from the base body to come into abutment against the lower surface of the mask, wherein each of the plurality of blades is formed of resin and comprises opposing edges vertically spaced relative to each other and symmetrical about the second axis such that each of the opposing edges is configured to be mounted to the base body as the paste scraping edge, and wherein each of the plurality of blades includes a pair of pressed portions protruding outward in the longitudinal direction from both end portions in the longitudinal direction, and the pair of pressed portions included in each of the plurality of blades are pressed by a pair of end members detachably mounted to the base body from above.

14. The mask cleaner of claim 13, wherein each of the pair of the pressed portions included in each of the plurality of blades has a horizontally symmetrical arc shape.

15. A blade for use in a mask cleaner that is provided in a screen printing apparatus for printing a paste onto a board through a mask, wherein the blade is mounted to a moving base that moves in a horizontal paste scraping direction under the mask, wherein the horizontal paste scraping direction corresponds to a first axis, wherein the blade moves under the mask integrally with the moving base to scrape off the paste adhering to a lower surface of the mask, wherein the blade is formed of resin and is detachably mounted to a base body that is mounted to the moving base and includes:

a longitudinal side extending in a longitudinal direction corresponding to a second axis, said longitudinal side being horizontal and intersecting the paste scraping direction and, and causes a paste scraping edge protruding upward from the base body to come into abutment against the lower surface of the mask, and wherein the blade comprises opposing edges vertically spaced relative to each other and symmetrical about the second axis such that each of the opposing edges is configured to be mounted to the base body as the paste scraping edge, and wherein the blade includes a pair of pressed portions protruding outward in the longitudinal direction from both end portions in the longitudinal direction, wherein the pair of pressed portions are pressed by a pair of end members detachably mounted to the base body from above.

16. The blade of claim 15, wherein each of the pair of pressed portions has a horizontally symmetrical arc shape.

17. The blade of claim 15, wherein an identification mark is provided for identifying a first edge and a second edge of the blade.

18. A screen printing apparatus comprising:

a print head that prints a paste onto a board through a mask, a moving base moving under the mask in a horizontal paste scraping direction corresponding to a first axis, and a mask cleaner mounted to the moving base and moving under the mask integrally with the moving base to scrape off the paste adhering to a lower surface of the mask, wherein the mask cleaner includes:

a base body mounted to the moving base and including a longitudinal side corresponding to a second axis, the longitudinal side being horizontal and intersecting the paste scraping direction, and a plurality of blades detachably mounted to the base body and extending in a longitudinal direction corresponding to the second axis and arranged side by side in parallel to the paste scraping direction, and causing a paste scraping edge protruding upward from the base body to come into abutment against the lower surface of the mask, and each of the plurality of blades is formed of resin and comprises opposing edges vertically spaced relative to each other and symmetrical about the second axis such that each of the opposing edges is configured to be mounted to the base body as the paste scraping edge, and wherein the base body comprises a frame defining an air passage opening, wherein adjacent blades of the plurality of blades define respective spaces therebetween, and wherein the base body blocks a rear most space of the respective spaces from the air passage opening.

19. A mask cleaner provided in a screen printing apparatus for printing a paste onto a board through a mask, the mask cleaner being mounted to a moving base that moves in a horizontal paste scraping direction under the mask, wherein the horizontal paste scraping direction corresponds to a first axis, and wherein the mask cleaner moves under the mask integrally with the moving base to scrape off the paste adhering to a lower surface of the mask, the mask cleaner comprising:

a base body mounted to the moving base and including a longitudinal side corresponding to a second axis, the longitudinal side being horizontal and intersecting the paste scraping direction, and a plurality of blades detachably mounted to the base body, extending in a longitudinal direction corresponding to the second axis and arranged side by side in parallel to the paste scraping direction, and causing a paste scraping edge protruding upward from the base body to come into abutment against the lower surface of the mask, wherein each of the plurality of blades is formed of resin and comprises opposing edges vertically spaced relative to each other and symmetrical about the second axis such that each of the opposing edges is configured to be mounted to the base body as the paste scraping edge, and wherein the base body comprises a frame defining an air passage opening, wherein adjacent blades of the plurality of blades define respective spaces therebetween, and wherein the base body blocks a rear most space of the respective spaces from the air passage opening.

* * * * *